US008787804B2

(12) United States Patent
Kishida et al.

(10) Patent No.: US 8,787,804 B2
(45) Date of Patent: Jul. 22, 2014

(54) DEVELOPING DEVICE INCLUDING A DEVELOPER CONTAINER WITH TONER PARTICLES AND MAGNETIC CARRIER PARTICLES (RZ=0.5–3.0 GM) AND A DEVELOPER BEARING MEMBER (RZ=10–30 GM), AND AN IMAGE FORMING APPARATUS AND PROCESS CARTRIDGE CONTAINING THE SAME

(75) Inventors: Hiroyuki Kishida, Shizuoka (JP); Shigenori Yaguchi, Shizuoka (JP); Toyoshi Sawada, Kanagawa (JP); Toyoaki Tano, Shizuoka (JP); Koichi Sakata, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 149 days.

(21) Appl. No.: 13/526,095

(22) Filed: Jun. 18, 2012

(65) Prior Publication Data

US 2013/0004209 A1 Jan. 3, 2013

(30) Foreign Application Priority Data

Jun. 29, 2011 (JP) ..... 2011-144343
May 25, 2012 (JP) ..... 2012-119919

(51) Int. Cl.
*G03G 15/08* (2006.01)

(52) U.S. Cl.
USPC ..... 399/277

(58) Field of Classification Search
USPC ..... 399/277
See application file for complete search history.

(56) References Cited

U.S. PATENT DOCUMENTS

2002/0122677 A1* 9/2002 Noda et al. ..... 399/277
2006/0063093 A1 3/2006 Kurosu
2009/0232532 A1* 9/2009 Sakata et al. ..... 399/53
2010/0104965 A1 4/2010 Inoue et al.
2010/0119255 A1 5/2010 Seshita et al.
2010/0216068 A1 8/2010 Kotsugai et al.
2010/0233613 A1 9/2010 Masuda et al.

(Continued)

FOREIGN PATENT DOCUMENTS

CN 1425959 A 6/2003
CN 1453660 A 11/2003

(Continued)

OTHER PUBLICATIONS

U.S. Appl. No. 13/412,195, filed Mar. 5, 2012, Sakata, et al.

*Primary Examiner* — Quana M Grainger
(74) *Attorney, Agent, or Firm* — Oblon, Spivak, McClelland, Maier & Neustadt, L.L.P.

(57) ABSTRACT

A developing device including a developer container and a developer bearing member is provided. The developer container contains a two-component developer comprising toner particles and magnetic carrier particles having a ten-point average surface roughness Rz of 0.5 to 3.0 μm. The developer bearing member is a cylindrical member containing a magnetic field generator having multiple magnetic poles. The developer bearing member is adapted to bear the two-component developer on a surface thereof and to convey the two-component developer as the surface rotates. The developer bearing member has a ten-point average surface roughness Rz of 10 to 30 μm. The multiple magnetic poles include three developer bearing poles each adapted to generate a magnetic field having a strength enough for retaining the two-component developer on a surface of the developer bearing member. The three developer bearing poles consist of a developing pole, a pre-developing pole, and a post-developing pole.

11 Claims, 6 Drawing Sheets

(56) References Cited

U.S. PATENT DOCUMENTS

| | | | |
|---|---|---|---|
| 2010/0239975 | A1 | 9/2010 | Yamaguchi et al. |
| 2011/0065037 | A1 | 3/2011 | Iwatsuki et al. |
| 2011/0086307 | A1 | 4/2011 | Nakajima et al. |
| 2011/0129775 | A1 | 6/2011 | Sawada et al. |
| 2011/0136051 | A1 | 6/2011 | Ishii et al. |
| 2011/0165508 | A1 | 7/2011 | Nakayama et al. |
| 2011/0170915 | A1 | 7/2011 | Aoki et al. |
| 2011/0171573 | A1 | 7/2011 | Sakata et al. |
| 2011/0217649 | A1 | 9/2011 | Masuda et al. |
| 2011/0229817 | A1 | 9/2011 | Yamada et al. |
| 2012/0009514 | A1 | 1/2012 | Nagayama et al. |
| 2012/0009518 | A1 | 1/2012 | Nagayama et al. |
| 2012/0028183 | A1 | 2/2012 | Nakajima et al. |
| 2012/0057898 | A1 | 3/2012 | Sakata et al. |
| 2012/0058423 | A1 | 3/2012 | Yamaguchi et al. |
| 2012/0064451 | A1 | 3/2012 | Kishida et al. |
| 2012/0129087 | A1* | 5/2012 | Iwami et al. ..... 430/106.2 |

FOREIGN PATENT DOCUMENTS

| | | | |
|---|---|---|---|
| CN | 101281383 | A | 10/2008 |
| CN | 101799654 | A | 8/2010 |
| JP | 9-160304 | | 6/1997 |
| JP | 11-184249 | | 7/1999 |
| JP | 2003-228240 | | 8/2003 |
| JP | 2006-235328 | | 9/2006 |
| JP | 2010-204639 | | 9/2010 |
| JP | 2011-13676 | | 1/2011 |

* cited by examiner

DEVELOPING DEVICE INCLUDING A DEVELOPER CONTAINER WITH TONER PARTICLES AND MAGNETIC CARRIER PARTICLES (RZ=0.5–3.0 GM) AND A DEVELOPER BEARING MEMBER (RZ=10–30 GM), AND AN IMAGE FORMING APPARATUS AND PROCESS CARTRIDGE CONTAINING THE SAME

CROSS-REFERENCE TO RELATED APPLICATIONS

This patent application is based on and claims priority pursuant to 35 U.S.C. §119 to Japanese Patent Application Nos. 2011-144343 and 2012-119919, filed on Jun. 29, 2011 and May 25, 2012, in the Japanese Patent Office, the entire disclosure of each of which is hereby incorporated herein by reference.

BACKGROUND

1. Technical Field

The present disclosure relates to a developing device, an image forming apparatus, and a process cartridge.

2. Description of Related Art

In electrophotography, two-component developing methods are widely employed that use a two-component developer comprised of toner particles and magnetic carrier particles. Two-component developing methods have an advantage over one-component developing methods in terms of durability and image quality. A typical two-component developing device includes a developer bearing member containing a magnetic field generator having multiple magnetic poles (hereinafter "developing sleeve"). The developing sleeve is configured to bear a developer on its surface and to convey the developer as it rotates.

Japanese Patent Application Publication No. 11-184249 describes a developing device having a developing sleeve containing a magnetic field generator. The magnetic field generator has five magnetic poles each of which is capable of generating a magnetic field having a strength enough for bearing a two-component developer. The five magnetic poles include a developer-supplying pole, a pre-developing developer-conveying pole, a developing pole, a developer-separating pole, and a post-developing developer-conveying pole. The developer-supplying pole contributes to supply of the two-component developer to the surface of the developing sleeve. The pre-developing developer-conveying pole contributes to conveyance of the supplied two-component developer to the developing area where the developing sleeve faces a latent image bearing member. The developing pole contributes to development of a latent image in the developing area. The developer-separating pole contributes to separation of the two-component developer from the developing sleeve after the developer has passed through the developing area. The post-developing developer-conveying pole is disposed between the developing pole and the developer-separating pole, and contributes to conveyance of the developer to the position where the developer separates from the developing sleeve after the developer has passed through the developing area.

A developer regulator is further disposed facing the developing sleeve between the developer-supplying pole and the pre-developing developer-conveying pole. The developer regulator is adapted to regulate the amount of two-component developer to be conveyed to the developing area. It is disclosed therein that the above configuration reliably performs the processes of supplying, conveying, and separating the two-component developer and developing latent images. Another two-component developing device has been also proposed further including a developer regulating pole disposed facing the developer regulator and no post-developing developer-conveying pole.

In accordance with recent demand for compact image forming apparatus, the developing device is required to be more compact, and therefore the developing sleeve is also required to have a smaller diameter. However, it may be difficult for a small-diameter developing sleeve to reliably perform the processes of supplying, conveying, and separating the two-component developer and developing latent images. This is because it is difficult for the small-diameter developing sleeve to contain at least five magnets which can generate a magnetic field having a strength enough for performing each process. Generally, the greater the magnetic force of a magnet, the greater the size of the magnet.

Japanese Patent Application Publication No. 2010-204639 describes a developing device including a magnetic field generator having only three magnetic poles which are capable of generating a magnetic field having a strength enough for bearing a two-component developer. The three magnetic poles include a developing pole, a pre-developing pole, and a post-developing pole. The developing pole generates a magnetic field in a developing area in which a developer bearing member faces an electrostatic latent image bearing member. The pre-developing pole generates a magnetic field for conveying a two-component developer supplied from a developer container to the developing area. The post-developing pole generates a magnetic field for separating the two-component developer from the developer bearing member at a downstream side from the developing area and an upstream side from the developing pole relative to a direction of rotation of the developer bearing member.

The above developing device is more compact because the magnetic field generator having only three magnetic poles occupies a much smaller space. Therefore, the developer bearing member can have a much smaller diameter. It is disclosed therein that the processes of supplying, conveying, and separating the two-component developer and developing latent images are reliably performed because such a compact developing device can generate a magnetic field having a strength enough for performing each process.

Such a compact developing device is likely to have a configuration such that the two-component developer is supplied from an upper side of the developer bearing member. The two-component developer supplied from the upper side of the developer bearing member is pressed against the developer bearing member due to its weight. The pressure from the two-component developer is different between an upstream side and a downstream side with respect to a supply screw that supplies the developer to the developer bearing member. At the upstream side, the two-component developer is pressed against the developer bearing member with a higher pressure and therefore the two-component developer forms dense ears on the developer bearing member. By contrast, at the downstream side, the two-component developer is pressed against the developer bearing member with a lower pressure and therefore the developer forms sparse ears on the developer bearing member. As a result, the resulting solid and halftone images may be lacking in uniformity between the upper side and the lower side with respect to the supply screw.

SUMMARY

In accordance with some embodiments, a developing device including a developer container and a developer bearing member is provided. The developer container contains a two-component developer comprising toner particles and magnetic carrier particles. The magnetic carrier particles have a ten-point average surface roughness Rz of 0.5 to 3.0 μm. The developer bearing member is a cylindrical member containing a magnetic field generator having multiple magnetic poles. The developer bearing member is adapted to bear the two-component developer on a surface thereof and to convey the two-component developer as the surface rotates. The developer bearing member has a ten-point average surface roughness Rz of 10 to 30 μm. The multiple magnetic poles include three developer bearing poles each adapted to generate a magnetic field having a strength enough for retaining the two-component developer on a surface of the developer bearing member. The three developer bearing poles consist of a developing pole, a pre-developing pole, and a post-developing pole. The developing pole is adapted to generate a first magnetic field in a developing area in which the developer bearing member faces an electrostatic latent image bearing member. The pre-developing pole is adapted to generate a second magnetic field. The second magnetic field supplies the two-component developer from the developer container to a surface of the developer bearing member and conveys the two-component developer to the developing area. The second and first magnetic fields retain the two-component developer on a surface of the developer bearing member between a position where the two-component developer is supplied thereto and the developing area. The post-developing pole is adapted to generate a third magnetic field. The third magnetic field separates the two-component developer from the developer bearing member at a downstream side from the developing area and an upstream side from the developing pole relative to a direction of rotation of the developer bearing member. The first and third magnetic fields retain the two-component developer on a surface of the developer bearing member between the developing area and a position where the two-component developer is separated therefrom.

In accordance with some embodiments, an image forming apparatus including an electrostatic latent image bearing member and the above developing device is provided.

In accordance with some embodiments, a process cartridge including an electrostatic latent image bearing member and the above developing device is provided. The process cartridge is detachably attachable to image forming apparatus

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
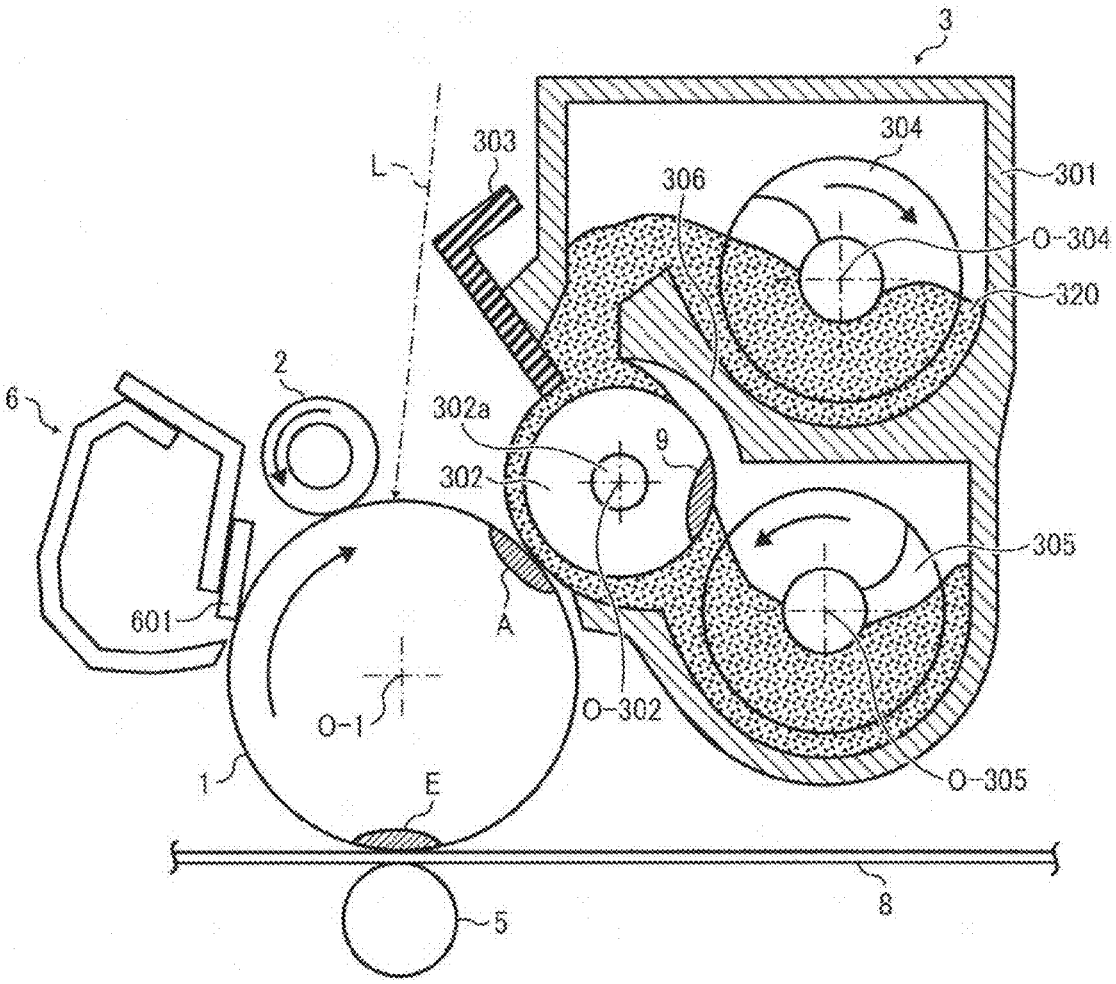
FIG. 1 is a schematic view illustrating an image forming apparatus according to an embodiment.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

A developing device according to an embodiment includes a developer bearing member and a developer container.

The developer bearing member is a cylindrical member containing a magnetic field generator having multiple magnetic poles. The developer bearing member is adapted to bear a two-component developer (hereinafter simply "developer") comprising toner particles and magnetic carrier particles on a surface thereof and to convey the two-component developer as the surface rotates. In one or more embodiments, a developing roller is employed as the developer bearing member.

The developing roller is not limited in size, shape, structure, and material. Materials usable for the developing rollers include, but are not limited to, non-magnetic materials such as stainless steel, aluminum, and ceramics, and those having coatings.

The developer container is adapted to contain the two-component developer.

The developing device may further include a developer supplier adapted to supply the two-component developer to a surface of the developer bearing member. In some embodiments, a supply roller is employed as the developer supplier.

The developing device may further include other members, for example, a developer layer thickness regulator adapted to regulate the amount of the two-component developer borne on the developing roller.

The developer layer thickness regulator may be a spring member comprised of a plate of a metal such as stainless steel (SUS) or phosphor bronze. A free end of the developer layer thickness regulator is in contact with a surface of the developing roller at a predetermined pressure, so that the two-component developer passed thereunder is formed into a thin layer.

The developer layer thickness regulator is disposed at a lower position than a position at which the supply roller is in contact with the developing roller.

According to an embodiment, the developer bearing member has a ten-point average surface roughness Rz of 10 to 30 μm. In some embodiments, the developer bearing member has a ten-point average surface roughness Rz of 15 to 20 μm. When Rz of the developer bearing member is less than 10 μm, it is likely that the developer forms ears more densely on a front side of the developer bearing member. When Rz of the developer bearing member is greater than 30 μm, it is likely that the developer forms ears more sparsely on a back side of the developer bearing member. Each of these cases results in production of non-uniform image.

The ten-point average surface roughness Rz of the developer bearing member can be measured by an instrument SURFCORDER SE-30H (from Kosaka Laboratory Ltd.) under the following measuring conditions.

Longitudinal magnification: 2,000 times
Transverse magnification: 2.5 times
Measuring length: 25 mm
Measuring speed: 2.0 mm/sec
Cutoff: fh 0.8 mm, fl 2.5 mm The developer bearing member is processed by means of sandblasting, grooving, grinding, sand paper, or index saver so that the ten-point average surface roughness Rz is get within the above-described range. For example, sandblasting is capable of randomly roughening a surface with a simple operation procedure and a high processing efficiency and uniformly improves frictional resistance in all direction between toner and the developer bearing member.

According to an embodiment, the magnetic carrier particles in the two-component developer have a ten-point average surface roughness Rz of 0.5 to 3.0 μm. In some embodiments, the magnetic carrier particles in the two-component developer have a ten-point average surface roughness Rz of 0.8 to 2.6 μm. When Rz of the magnetic carrier particles are less than 0.5 μm, it is likely that the developer forms ears more sparsely on a front side of the developer bearing member, resulting in production of non-uniform image. When Rz of the magnetic carrier particles are greater than 3.0 μm, it is likely that a covering layer formed on each magnetic carrier particle is abraded due to collision between the developer bearing member and each magnetic carrier particles, and therefore the magnetic carrier particles are scattered, resulting in production of abnormal image.

The ten-point average surface roughness Rz of the magnetic carrier particle can be measured by a confocal microscope (OPTELICS® C130 from Lasertec Corporation) by analyzing the three-dimensional structure of the surface of the magnetic carrier particle under the following measuring conditions. More specifically, Rz is determined by measuring a height curve of the surface of the magnetic carrier particle within a specified range and determine the center line, summing the absolute deviations of the measured height curve from the center line, and averaging the sum.

Objective lens magnification: 50 times
Resolution: 0.20
Analysis: Averaging Rz obtained from randomly selected 20 specified ranges (10 μm×10 μm) per sample.

The ten-point average surface roughness Rz of the magnetic carrier particles can be adjusted by, for example, (1) varying the mixing ratio of resins in its covering layer, (2) varying the amount and kind of conductive particles included in the covering layer, (3) varying the thickness of the covering layer, and (4) varying the viscosity of the covering layer liquid.

The two-component developer comprises toner particles and magnetic carrier particles.

In some embodiments, the two-component developer includes the toner particles in an amount of 1 to 10.0 parts by weight based on 100 parts by weight of the magnetic carrier particles.

The magnetic carrier particle comprises a core material and a covering layer.

Specific materials usable for the magnetic carrier particle include, but are not limited to, ferrite, Cu—Zn ferrite, Mn ferrite, Mn—Mg ferrite, Mn—Mg—Sr ferrite, magnetite, iron, and nickel.

The core material can be prepared by the following procedure, for example. First, weigh appropriate amounts of raw materials (e.g., MnO, MgO, $Fe_2O_3$, $SrCO_3$) and disperse them in an appropriate amount of water with a disperser, such as a ball mill or a vibration mill, for 0.5 to 24 hours, to prepare a slurry. Subsequently, dry the slurry, pulverize the dried product, and pre-burn the pulverized product at 500 to 1,500° C. Pulverize the pre-burnt product into particles having a desired particle diameter with a ball mill. Mix the particles with water, a binder resin, and other optional additives, and spray-dry the mixture into grains. Burn the grains in a furnace at 800 to 1,600° C. Pulverize and classify the burnt grains to obtain particle having a desired particle size. Re-oxidize the surfaces of the obtained particles again, if needed. Saturated magnetization can be adjusted by varying the kind of raw materials used, the burning temperature, and/or an oxidization treatment.

The covering layer comprises a binder resin and conductive fine particles.

Specific examples of the binder resin include, but are not limited to, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymer of vinylidene fluoride and an acrylic monomer, copolymer of vinylidene fluoride and vinyl fluoride, fluoroterpolymer (e.g., terpolymer of tetrafluoroethylene, vinylidene fluoride, and a non-fluoride monomer), and silicone resins. Two or more of these resins can be used in combination. In some embodiments, a silicone resin and/or an acrylic resin is used. When silicone and acrylic resins are used in combination, the resins form a sea-island structure in the covering layer. The sea-island structure forms appropriate roughness on the surface of the magnetic carrier particle. Such magnetic carrier particles having an appropriate surface roughness can keep a proper distance from each other and are prevented from producing defective images with uneven image density or undesired lines.

In some embodiments, the weight ratio of the acrylic resin to the silicone resin is 1/9 to 5/5. When the ratio is less than 1/9, the amount of the acrylic resin is too small to form a sea-island structure. When the ratio is greater than 5/5, the amount of the acrylic resin is so large that the resulting carrier particles are likely to aggregate, resulting in poor quality image.

Usable silicone resins include, but are not limited to, straight silicone resins consisting of organosiloxane bonds, and silicone resins modified with alkyd, polyester, epoxy, acrylic, or urethane.

Specific examples of commercially available silicone resins include, but are not limited to, KR271, KR255, and KR152 (from Shin-Etsu Chemical Co., Ltd.); and SR2400, SR2406, and SR2410 (from Dow Corning Toray Co., Ltd.). The silicone resin can be used alone or in combination with other components such as a cross-linkable component and a charge controlling component. Specific examples of commercially available modified silicone resins include, but are not limited to, KR206 (alkyd-modified), KR5208 (acrylic-modified), ES1001N (epoxy-modified), and KR305 (urethane-modified) (from Shin-Etsu Chemical Co., Ltd.); and SR2115 (epoxy-modified) and SR2110 (alkyd-modified) (from Dow Corning Toray Co., Ltd.).

Usable acrylic resins include all resins having an acrylic component. The acrylic resin can be used alone or in combination with at least one cross-linkable component, such as an amino resin and an acidic catalyst. Usable amino resins include, but are not limited to, guanamine resins and melamine resins. The acidic catalyst may be, for example, a catalyst having a reactive group of a completely alkylated type, a methylol group type, an imino group type, or a methylol/imino group type.

Specific materials usable for the conductive fine particles include, but are not limited to, metal powders, titanium oxide, tin oxide, zinc oxide, alumina, indium tin oxide (ITO), carbon black, and titanium oxide particle surface-treated with antimony-doped indium oxide. Two or more of these materials can be used in combination.

The conductive fine particles are adapted to protect the covering layer from external force. Therefore, in case the conductive fine particles tend to fracture or wear upon application of external force, it may be difficult to protect the covering layer for an extended period of time. In accordance with some embodiments, the conductive fine particles are resistant to external force because of having high toughness. The conductive fine particles are likely to cause neither fracture nor wear and are capable of protecting the covering layer for an extended period of time.

In some embodiments, the conductive fine particles exist in the acrylic resin in the covering layer. In such embodiments, the conductive fine particles can be more reliably retained in the covering layer due to a high adhesive property of the acrylic resin.

In some embodiments, the content of the conductive fine particles is 0.1 to 1,000 parts by weight, or 70 to 700 parts by weight, based on 100 parts by weight of the binder resin.

In some embodiments, the covering layer further includes a silane coupling agent to more reliably disperse the conductive fine particles.

Specific examples of usable silane coupling agents include, but are not limited to, γ-(2-aminoethyl)aminopropyl trimethoxysilane, γ-(2-aminoethyl)aminopropylmethyl dimethoxysilane, γ-methacryloxypropyl trimethoxysilane, N-β-(N-vinylbenzylaminoethyl)-γ-aminopropyl trimethoxysilane hydrochloride, γ-glycidoxypropyl trimethoxysilane, γ-mercaptopropyl trimethoxysilane, methyl trimethoxysilane, methyl triethoxysilane, vinyl triacetoxysilane, γ-chloropropyl trimethoxysilane, hexamethyl disilazane, γ-anilinopropyl trimethoxysilane, vinyl trimethoxysilane, octadecyldimethyl[3-(trimethoxysilyl)propyl]ammonium chloride, γ-chloropropylmethyl dimethoxysilane, methyl trichlorosilane, dimethyl dichlorosilane, trimethyl chlorosilane, allyl triethoxysilane, 3-aminopropylmethyl diethoxysilane, 3-aminopropyl trimethoxysilane, dimethyl diethoxysilane, 1,3-divinyltetramethyl disilazane, and methacryloxyethyldimethyl(3-trimethoxysilylpropyl) ammonium chloride. Two or more of these materials can be used in combination.

Specific examples of commercially available silane coupling agents include, but are not limited to, AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (from Dow Corning Toray Co., Ltd.). Two or more of these materials can be used in combination.

In some embodiments, the content of the silane coupling agent is 0.1 to 10% by weight based on the binder resin. When the content of the silane coupling agent is less than 0.1% by weight, the covering layer may release from the core material in a long-term use due to weak adhesiveness between the binder resin and the core particle and/or conductive fine particles. When the content of the silane coupling agent is greater than 10% by weight, toner filming may occur in a long-term use.

A condensation reaction for preparing a silicone resin as the binder resin can be accelerated by using a catalyst, such as a titanium-based catalyst, a tin-based catalyst, a zirconium-based catalyst, or an aluminum-based catalyst. In some embodiments, a titanium-based catalyst, such as a titanium alkoxide catalyst or a titanium chelate catalyst, is used. The titanium-based catalysts effectively accelerate the condensation reaction of silanol groups while keeping good catalytic ability.

Specific examples of the titanium alkoxide catalysts include, but are not limited to, titanium diisopropoxy bis (ethylacetoacetate) having the following formula (1). Specific examples of the titanium chelate catalysts include, but are not limited to, titanium diisopropoxy bis(triethanolaminate) having the following formula (2).

$$Ti(O\text{-}i\text{-}C_3H_7)_2(C_6H_9O_3)_2 \quad \text{Formula (1)}$$

$$Ti(O\text{-}i\text{-}C_3H_7)_2(C_6H_{14}O_3N)_2 \quad \text{Formula (2)}$$

The covering layer can be formed by, for example, dissolving raw materials (e.g., a binder resin) in a solvent to prepare an application liquid and uniformly applying the application liquid to the surface of the core material, followed by drying and baking. The applying procedure may be performed by means of dipping, spraying, or brush-application.

Usable solvents include, but are not limited to, toluene, xylene, methyl ethyl ketone, methyl isobutyl ketone, cellosolve, and butyl acetate.

The baking procedure may be performed by either external or internal heating method using a stationary electric furnace, a fluid electric furnace, a rotary electric furnace, a burner furnace, or microwave.

In some embodiments, the formula $0.5 \leq D/h \leq 1.1$, or $0.7 \leq D/h \leq 0.9$, is satisfied, wherein D represents the volume average particle diameter of the conductive fine particles and h represents the average thickness of the covering layer. When D/h is less than 0.5, the conductive fine particles are embedded in the binder resin while reducing surface roughness and excessively increasing fluidity of the magnetic carrier particles. Such magnetic carrier particles with a relatively smooth surface can be densely packed and therefore form stiff developer ears. The stiff developer ears may strongly rub an electrostatic latent image on an image bearing member in the developing area and thereby produce defective image. By contrast, when D/h is greater than 1.1, surface roughness of the magnetic carrier particles increases. Such magnetic carrier particles with a relatively rough surface can be packed only sparsely. Thus, the developer ears formed on the developer bearing member get nonuniform in density depending on a pressure difference between the front and back sides of the developer bearing member, resulting in production of nonuniform image.

In some embodiments, the average thickness h of the covering layer is 0.05 to 4 μm, or 0.08 to 3 μm. When the average thickness h is less than 0.05 μm, the covering layer may be easily destroyed or abraded. When the average thickness is greater than 4 μm, the carrier particles may easily adhere to the resulting images because the covering layer has no magnetic property.

The average thickness h of the covering layer can be determined by observing a cross-section of the magnetic carrier particle using a transmission electron microscope (TEM) and measuring the thickness of the covering layer at several portions. In particular, binder resin portions which are lying between a surface portion of the core particle and a conductive fine particle are subjected to the measurement of thickness. Binder resin portions which are lying between two conductive fine particles or those which are lying between a surface portion of the covering layer and a conducive particle are not taken into consideration. The average thickness h is the average value of the thicknesses measured at 50 randomly-selected portions of the covering layer in the cross-section.

In some embodiments, the volume average particle diameter D of the conductive fine particles is 0.2 to 1.5 μm, or 0.3 to 1 μm.

The volume average particle diameter D of the conductive fine particles can be determined by an automatic particle size distribution analyzer CAPA-700 (from Horiba, Ltd.).

In some embodiments, the magnetic carrier particles have a weight average particle diameter of 25 to 45 μm. When the weight average particle diameter is less than 25 μm, carrier deposition may occur. When the weight average particle diameter is greater than 45 μm, thin lines may not be precisely reproduced in the resulting image.

The weight average particle diameter of the magnetic carrier particles can be measured by a Microtrac particle size analyzer HRA9320-X100 (from Nikkiso Co., Ltd.).

The toner comprises a binder resin and a colorant. The toner may optionally include other materials such as a release agent, a charge controlling agent, and an external additive.

The toner may be either a monochrome toner for producing monochrome images or a full-color toner for producing full-color images. The toner may include a release agent so as to be usable in oilless fixing systems in which no oil is applied to a fixing member. Even when such a toner including a release agent is likely to cause filming, the magnetic carrier particles according to an embodiment can prevent the occurrence of filming. Therefore, the two-component developer according to an embodiment can provide high-quality images for an extended period of time. Because the magnetic carrier particles according to an embodiment prevent peeling off of the covering layer, even yellow images may not be contaminated.

Specific examples of usable binder resins for the toner include, but are not limited to, homopolymers of styrene or styrene derivatives (e.g., polystyrene, polyvinyl toluene), styrene-p-chlorostyrene copolymer, styrene-propylene copolymer, styrene-vinyl toluene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleic acid copolymer, styrene-maleate copolymer, polymethyl methacrylate, polybutyl methacrylate, polyvinyl chloride, polyvinyl acetate, polyethylene resin, polypropylene resin, polyester resin, polyurethane resin, epoxy resin, polyvinyl butyral resin, polyacrylic acid resin, rosin, modified rosin, terpene resin, phenol resin, aliphatic hydrocarbon resin, and aromatic petroleum resin. Two or more of these resins can be used in combination. In some embodiments, a polyester resin is used because of having a lower melt viscosity while keeping storage stability.

The polyester resin can be obtained from a polycondensation reaction between an alcohol and a carboxylic acid.

Specific examples of usable alcohols include, but are not limited to, diols (e.g., polyethylene glycol, diethylene glycol, triethylene glycol, 1,2-propylene glycol, 1,3-propylene glycol, 1,4-propylene glycol, neopentyl glycol, 1,4-butenediol), etherified bisphenols (e.g., 1,4-bis(hydroxymethyl)cyclohexane, bisphenol A, hydrogenated bisphenol A, polyoxyethylenated bisphenol A, polyoxypropylenated bisphenol A), divalent alcohols in which the above compounds are substituted with a saturated or unsaturated hydrocarbon group having 3 to 22 carbon atoms, other divalent alcohols, and tri- or more valent alcohols (e.g., sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene). Two or more of these materials can be used in combination.

Specific examples of usable carboxylic acids include, but are not limited to, monocarboxylic acids (e.g., palmitic acid, stearic acid, oleic acid), maleic acid, fumaric acid, mesaconic acid, citraconic acid, terephthalic acid, cyclohexanedicarboxylic acid, succinic acid, adipic acid, sebacic acid, malonic acid, divalent organic acids in which the above compounds are substituted with a saturated or unsaturated hydrocarbon group having 3 to 22 carbon atoms, anhydrides and lower esters of the above compounds, dimer acids of linoleic acid, and tri- or more valent carboxylic acids (e.g., 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 3,3-dicarboxymethylbutanoic acid, tetra(carboxymethyl)methane, 1,2,7,8-octanetetracarboxylic acid enpol trimmer acid, and anhydrides of these compounds). Two or more of these materials can be used in combination.

Specific examples of usable colorants include, but are not limited to, dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these materials can be used in combination.

In some embodiments, the content of the colorant in the toner is 1 to 15% by weight, or 3 to 10% by weight.

The colorant can be combined with a resin to be used as a master batch. Specific examples of usable resins include, but are not limited to, polymers of styrene or styrene derivatives, styrene-based copolymers, polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Two or more of these resins can be used in combination.

Specific materials usable for the release agent include, but are not limited to, wax.

Specific examples of usable waxes include, but are not limited to, carbonyl-group-containing wax, polyolefin wax, and long-chain hydrocarbon. Two or more of these materials can be used in combination. In some embodiments, a carbonyl-group-containing wax is used.

Specific examples of the carbonyl-group-containing wax include, but are not limited to, polyalkanoic acid ester, polyalkanol ester, polyalkanoic acid amide, polyalkyl amide, and dialkyl ketone. Specific examples of the polyalkanoic acid ester include, but are not limited to, carnauba wax, montan wax, trimethylolpropane tribehenate, pentaerythritol tetrabehenate, pentaerythritol diacetate dibehenate, glycerin tribehenate, and 1,18-octadecanediol distearate. Specific examples of the polyalkanol ester include, but are not limited to, tristearyl trimellitate and distearyl maleate. Specific examples of the polyalkanoic acid amide include, but are not limited to, dibehenyl amide. Specific examples of the polyalkyl amide include, but are not limited to, trimellitic acid tristearyl amide. Specific examples of the dialkyl ketone include, but are not limited to, distearyl ketone. In some embodiments, a polyalkanoic acid ester is used.

Specific examples of the polyolefin wax include, but are not limited to, polyethylene wax and polypropylene wax.

Specific examples of the long-chain hydrocarbon include, but are not limited to, paraffin wax and SAZOL wax.

In some embodiments, the content of the release agent in the toner is 5 to 15% by weight.

Specific examples of usable charge controlling agents include, but are not limited to, nigrosine dyes, azine dyes having an alkyl group having 2 to 16 carbon atoms described in Examined Japanese Application Publication No. 42-1627; basic dyes (e.g., C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), C.I. Basic Green 4 (C.I. 42000)) and lake pigments thereof; quaternary ammonium salts (e.g., C.I. Solvent Black 8 (C.I. 26150), benzoylmethylhexadecyl ammonium chloride, decyltrimethyl chloride); dialkyl (e.g., dibutyl, dioctyl) tin compounds; dialkyl tin borate compounds; guanidine derivatives; polyamine resins (e.g., vinyl polymers having amino group, condensed polymers having amino group); metal complex salts of monoazo dyes described in Examined Japanese Application Publication Nos. 41-20153, 43-27596, 44-6397, and 45-26478; metal complexes of salicylic acid, dialkyl salicylic acid, naphthoic acid, and dicarboxylic acid with Zn, Al, Co, Cr, and Fe, described in Examined Japanese Application Publication Nos. 55-42752 and 59-7385; sulfonated copper phthalocyanine pigments; organic boron salts; fluorine-containing quaternary ammonium salts; and calixarene compounds. Two or more of these materials can be used in combination.

In some embodiments, the toners having colors other than black include a metal salt of a salicylic acid derivative that is white.

Specific examples of usable external additives include, but are not limited to, inorganic particles of silica, titanium oxide, alumina, silicon carbide, silicon nitride, and boron nitride; and resin particles of polymethyl methacrylate or polystyrene having an average particle diameter of 0.05 to 1 μm, which are obtained by a soap-free emulsion polymerization. Two or more of these materials can be used in combination. In some embodiments, hydrophobized metal oxides such as silica and titanium oxide are used. When a hydrophobized silica and a hydrophobized titanium oxide are used in combination and the amount of the hydrophobized titanium oxide is greater than that of the hydrophobized silica, the toner has excellent charge stability regardless of humidity.

The toner may further include other additives such as a fluidizer, a cleanability improving agent, a magnetic material, and a metal soap.

Fluidity improving agents are adapted to improve hydrophobicity of toner by surface treatment so as to prevent deterioration of fluidity and chargeability in high-humidity conditions. Specific materials usable for the fluidity improving agent include, but are not limited to, silane coupling agents, silylation agents, silane coupling agents having a fluorinated alkyl group, organic titanate coupling agents, aluminum coupling agents, silicone oils, and modified silicone oils.

Cleanability improving agents are adapted to improve removability of toner from an electrostatic latent image bearing member or intermediate transfer medium. Specific materials usable for the cleanability improving agent include, but are not limited to, metal salts of fatty acids (e.g., zinc stearate, calcium stearate) and fine particles of polymers prepared by soap-free emulsion polymerization (e.g., polymethyl methacrylate, polystyrene). In some embodiments, the fine particles of polymers have a narrow size distribution and a volume average particle diameter of 0.01 to 1 μm.

Specific examples of usable magnetic materials include, but are not limited to, iron powder, magnetite, and ferrite. In some embodiments, a magnetic material having a whitish color is used.

The toner may be manufactured by various processes such as kneading-pulverization process, polymerization process, dissolution suspension process, and spray granulation process.

A kneading-pulverization process generally includes the steps of melt-kneading raw materials such as a binder resin and a colorant, pulverizing the melt-kneaded mixture into particles, and classifying the particles by size to prepare mother particles.

In the melt-kneading step, raw materials are mixed and the mixture is melt-kneaded by a melt-kneader. Usable melt-kneaders include, but are not limited to, single-axis or double-axis continuous kneaders and roll mill batch kneaders. Usable commercially-available melt-kneaders include, but are not limited to, TWIN SCREW EXTRUDER KTK (from Kobe Steel, Ltd.), TWIN SCREW COMPOUNDER TEM (from Toshiba Machine Co., Ltd.), MIRACLE K.C.K (from Asada Iron Works Co., Ltd.), TWIN SCREW EXTRUDER PCM (from Ikegai Co., Ltd.), and KOKNEADER (from Buss Corporation). The melt-kneading conditions are adjusted so as not to cut molecular chains of the binder resin. For example, when the melt-kneading temperature is too much higher than the softening point of the binder resin, molecular chains may be significantly cut. When the melt-kneading temperature is too much lower than the softening point of the binder resin, the raw materials may not be sufficiently kneaded.

In the pulverizing step, the kneaded product is pulverized into particles. The kneaded product may be first pulverized into coarse particles and subsequently pulverized into fine particles. Specific pulverization methods include, for example, a method in which the kneaded product is brought into collision with a collision plate in a jet stream, a method in which particles are brought into collision with each other in a jet stream, and a method in which the kneaded product is pulverized within a narrow gap between mechanically rotating rotor and stator.

In the classifying step, the resulting particles are classified by size to collect particles having a predetermined size. Undesired fine particles are removed by means of cyclone separation, decantation, or centrifugal separation, for example.

Thereafter, the particles are further classified in an airflow by centrifugal force to obtain mother toner particles having a predetermined size.

The external additive and the mother toner particles are mixed and agitated by a mixer so that the external additive is adhered to the surfaces of the mother toner particles while being pulverized by the agitation. In view of durability of the toner, the external additive (e.g., inorganic fine particles, resin particles) is uniformly and fixedly adhered to the mother toner particles.

A polymerization process includes, for example, the step of dissolving or dispersing raw materials, including a modified polyester capable of forming urea or urethane bond and a colorant, in an organic solvent. The process further includes the steps of dispersing the resulting solution or dispersion in an aqueous medium to cause a polyaddition reaction, removing the organic solvent from the dispersion, and washing the dispersion.

The modified polyester capable of forming urea or urethane bond may be, for example, a polyester prepolymer (A) having an isocyanate group which can be obtained by reacting a terminal carboxyl or hydroxyl group of a polyester with a polyisocyanate compound (PIC). Molecular chains of the polyester prepolymer (A) can be cross-linked and/or elongated with an amine (B). The resulting modified polyester resin has a good combination of low-temperature fixability and hot offset resistance.

Specific examples of usable polyisocyanates (PIC) include, but are not limited to, aliphatic polyisocyanates (e.g., tetramethylene diisocyanate, hexamethylene diisocyanate, 2,6-diisocyanatomethyl caproate), alicyclic polyisocyanates (e.g., isophorone diisocyanate, cyclohexylmethane diisocyanate), aromatic diisocyanates (e.g., tolylene diisocyanate, diphenylmethane diisocyanate), aromatic aliphatic diisocyanates (e.g., $\alpha,\alpha,\alpha',\alpha'$-tetramethylxylylene diisocyanate), isocyanurates, and the above polyisocyanates in which the isocyanate group is blocked with a phenol derivative, an oxime, or a caprolactam. Two or more of these materials can be used in combination.

In some embodiments, the equivalent ratio [NCO]/[OH] of isocyanate groups [NCO] in the polyisocyanate (PIC) to hydroxyl groups [OH] in the polyester having a hydroxyl group is 5/1 to 1/1, 4/1 to 1.2/1, or 2.5/1 to 1.5/1.

In some embodiments, the average number of isocyanate groups included in one molecule of the polyester prepolymer (A) is 1 or more, 1.5 to 3, or 1.8 to 2.5.

The amine (B) may be, for example, a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked.

Specific examples of the diamine (B1) include, but are not limited to, aromatic diamines (e.g., phenylenediamine, diethyltoluenediamine, 4,4'-diaminodiphenylmethane); alicyclic diamines (e.g., 4,4'-diamino-3,3'-dimethyldicyclohexylmethane, diamine cyclohexane, isophoronediamine); and aliphatic diamines (e.g., ethylenediamine, tetramethylenediamine, hexamethylenediamine).

Specific examples of the polyamine (B2) having 3 or more valences include, but are not limited to, diethylenetriamine and triethylenetetramine.

Specific examples of the amino alcohol (B3) include, but are not limited to, ethanolamine and hydroxyethylaniline.

Specific examples of the amino mercaptan (B4) include, but are not limited to, aminoethyl mercaptan and aminopropyl mercaptan.

Specific examples of the amino acid (B5) include, but are not limited to, aminopropionic acid and aminocaproic acid.

Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds. In some embodiments, a diamine (B1) alone or a mixture of a diamine (B1) with a small amount of a polyamine (B2) having 3 or more valences is used.

In some embodiments, the equivalent ratio [NCO]/[NHx] of isocyanate groups [NCO] in the polyester prepolymer (A) to amino groups [NHx] in the amine (B) is 1/2 to 2/1, 1.5/1 to 1/1.5, or 1.2/1 to 1/1.2.

Polymerization processes produces small-size spherical toner particles while reducing environmental load and manufacturing cost.

An image forming method according to an embodiment includes at least an electrostatic latent image forming process, a developing process, a transfer process, and a fixing process. The image forming method may optionally include other processes such as a neutralization process, a cleaning process, a recycle process, and a control process, if needed.

The developing process is performed by the developing device according to an embodiment.

An image forming apparatus according to an embodiment includes at least an electrostatic latent image bearing member, an electrostatic latent image forming device, a developing device, a transfer device, and a fixing device. The image forming apparatus may optionally include other members, such as a neutralizer, a cleaner, a recycler, and a controller, if needed. The developing device is that according to an embodiment.

The electrostatic latent image forming process is a process which forms an electrostatic latent image on an electrostatic latent image bearing member.

The electrostatic latent image bearing member (hereinafter may be referred to as "electrophotographic photoreceptor", "photoreceptor", or "latent image bearing member") is not limited in material, shape, structure, and size. In some embodiments, the electrostatic latent image bearing member has a drum-like shape and is comprised of an inorganic photoconductor, such as amorphous silicone or selenium, or an organic photoconductor, such as polysilane or phthalopolymethyne. In some embodiments, amorphous silicone is used in view of its long lifespan.

In the electrostatic latent image forming process, an electrostatic latent image forming device uniformly charges a surface of the electrostatic latent image bearing member and irradiates the charged surface with light containing image information. The electrostatic latent image forming device comprises a charger for uniformly charging a surface of the electrostatic latent image bearing member and an irradiator for irradiating the charged surface with light containing image information.

The charger is adapted to charge a surface of the electrostatic latent image bearing member by supplying a voltage thereto.

The charger may be, for example, a contact charger equipped with a conductive or semiconductive roll, brush, film, or rubber blade, or a non-contact charger such as corotron and scorotron that use corona discharge.

The irradiator is adapted to irradiate the charged surface of the electrostatic latent image bearing member with light containing image information.

The irradiator may be, for example, a radiation optical type, a rod lens array type, a laser optical type, or a liquid crystal shutter optical type.

The electrostatic latent image bearing member may be irradiated with light from the reverse surface (back surface) side thereof.

The developing process is a process which develops the electrostatic latent image into a toner image with a toner or developer.

The developing process is performed by the developing device according to an embodiment.

The transfer process is a process which transfers the toner image onto a recording medium. In some embodiments, the toner image is primarily transferred onto an intermediate transfer member and secondarily transferred onto the recording medium. In some embodiments, a plurality of toner images with different colors is primarily transferred onto the intermediate transfer medium to form a composite toner image and the composite toner image is secondarily transferred onto the recording medium.

In the transfer process, the transfer device, such as a transfer charger, charges the electrostatic latent image. In some embodiments, the transfer device includes a plurality of primary transfer devices each adapted to transfer a toner image onto the intermediate transfer medium to form a composite toner image, and a secondary transfer device adapted to transfer the composite toner image onto the recording medium.

The intermediate transfer medium may be, for example, a transfer belt.

In some embodiments, each transfer device (including the primary transfer device and the secondary transfer device) contains a transfer unit adapted to separate a toner image from the electrostatic latent image bearing member toward a recording medium side. The number of transfer devices is not limited, i.e., one or more.

The transfer unit may be, for example, a corona discharger, a transfer belt, a transfer roller, a pressure transfer roller, or an adhesive transfer unit.

The recording medium is not limited to a specific material, and any kind of material can be used as the recording medium.

The fixing process is a process which fixes the toner image on the recording medium. Each single-color toner image may be independently fixed on the recording medium, or alternatively, a composite toner image including a plurality of color toner images may be fixed on the recording medium at once.

In some embodiments, the fixing device includes fixing members adapted to fix a toner image by application of heat and pressure. For example, the fixing device may include a combination of a heating roller and a pressing roller, or a combination of a heating roller, a pressing roller, and an endless belt.

In some embodiments, the heating member is heated to a temperature of 80 to 200° C.

In the fixing process, an optical fixer can be used in place of or in combination with the fixing device.

The neutralization process is a process in which the neutralizer neutralizes the electrostatic latent image bearing member by supplying a neutralization bias thereto.

The neutralizer may be, for example, a neutralization lamp.

The cleaning process is a process in which the cleaner removes residual toner particles remaining on the electrostatic latent image bearing member.

The cleaner may be, for example, a magnetic brush cleaner, an electrostatic brush cleaner, a magnetic roller cleaner, a blade cleaner, a brush cleaner, or a web cleaner.

The recycle process is a process in which the recycler supplies the residual toner particles collected in the cleaning process to the developing device.

The recycler may be, for example, a conveyer.

The control process is a process in which the controller controls the above-described processes.

The controller may be, for example, a sequencer or a computer.

FIG. 1 is a schematic view illustrating an image forming apparatus according to an embodiment. The image forming apparatus includes an electrostatic latent image bearing member (photoreceptor) 1 and a developing device 3 according to an embodiment.

The photoreceptor 1 rotates clockwise in FIG. 1. A charger 2 is disposed on an upper side of the photoreceptor 1. In this embodiment, the charger 2 employs a rotating body rotatable at the same speed as the photoreceptor 1. According to another embodiment, the charger 2 may employ a corona charger.

The charger 2 uniformly charges a surface of the photoreceptor 1 in darkness. The charged surface of the photoreceptor 1 is exposed to light L emitted from an irradiator. Thus, an electrostatic latent image is formed on the photoreceptor 1. The electrostatic latent image is conveyed downstream as the photoreceptor 1 rotates so as to face the developing device 3. The developing device 3 is disposed on a right side of the photoreceptor 1 in FIG. 1.

The developing device 3 includes a casing 301, a supply chamber conveyer 304, a collection chamber conveyer 305, and a developing roller 302. The supply chamber conveyer 304 and collection chamber conveyer 305 are both adapted to agitate and convey a developer 320.

The developing roller 302 is disposed facing the photoreceptor 1 while forming a developing area A therebetween. The casing 301 has an opening that exposes the developing roller 302 to the photoreceptor 1.

The developing roller 302 is adapted to convey the developer 320 from inside of the casing 301 to the developing area A. In the developing area A, toner particles contained in the developer 320 are adhered to the electrostatic latent image on the photoreceptor 1. Thus, the electrostatic latent image is developed into a toner image.

The toner image is conveyed downstream as the photoreceptor 1 rotates so as to face a transfer device 5. The transfer device 5 is disposed on a lower side of the photoreceptor 1 in FIG. 1. In this embodiment, the transfer device 5 employs a rotating body. According to another embodiment, the transfer device 5 may employ a corona charger. The transfer device 5 is disposed facing the photoreceptor 1 while forming a transfer area E therebetween.

In the transfer area E, the toner image is transferred from the photoreceptor 1 onto a recording medium 8. According to another embodiment, in the transfer area E, the toner image may be transferred from the photoreceptor 1 onto an intermediate transfer member (e.g., an intermediate transfer belt).

The surface of the photoreceptor 1 from which the toner image has been transferred is conveyed downstream as the photoreceptor 1 rotates so as to face a cleaner 6. The cleaner 6 is disposed on a substantially left side of the photoreceptor 1 in FIG. 1. In the cleaner 6, a cleaning blade 601 removes residual toner particles remaining on the photoreceptor 1 without being transferred onto the recording medium 8. The surface of the photoreceptor 1 from which residual toner particles have been removed by the cleaner 6 is uniformly charged by the charger 2 again. These image forming processes are repeated.

As described above, the developing device 3 includes the casing 301, the developing roller 302, the supply chamber conveyer 304, and the collection chamber conveyer 305, and further includes a developer layer thickness regulator 303. The supply chamber conveyer 304 and collection chamber conveyer 305 are both adapted to agitate and convey the developer 320 so that the developer 320 is circulated within the casing 301.

In this embodiment, each of the supply chamber conveyer 304 and collection chamber conveyer 305 employs a screw having a spiral blade having an outer diameter of 16 mm or less.

Figure 2:
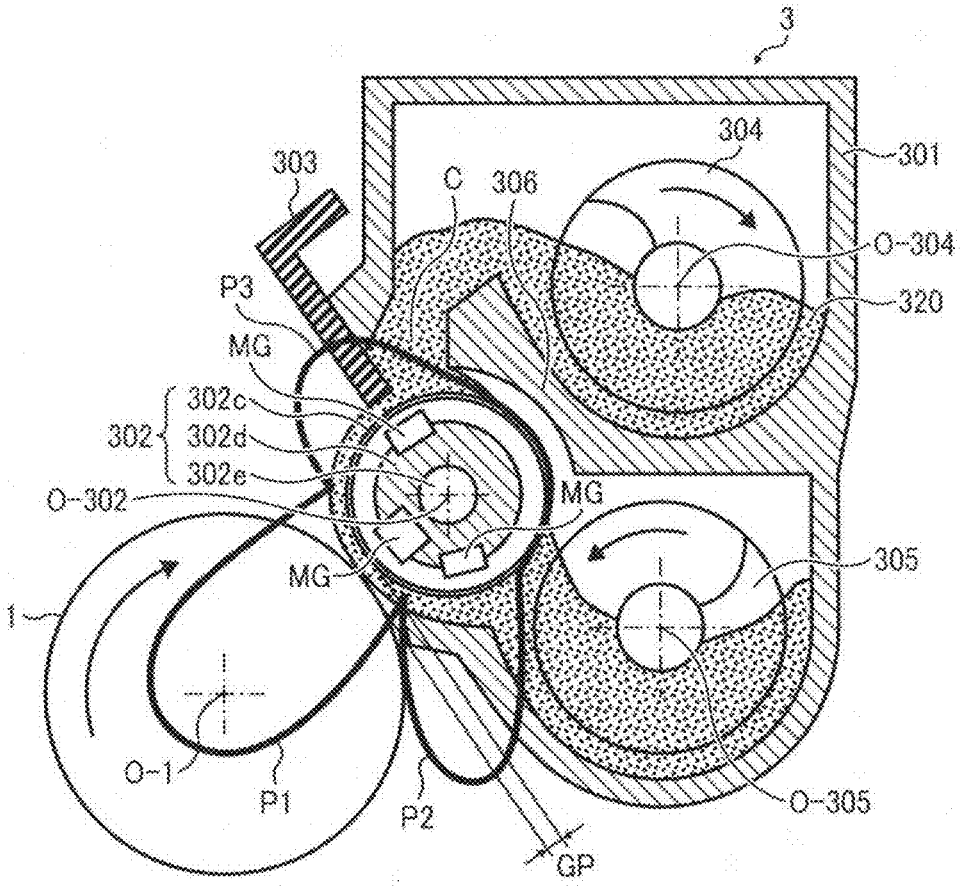
FIG. 2 is a magnified view of the developing device included in the image forming apparatus illustrated in FIG. 1.

FIG. 2 is a magnified view of the developing device 3. Referring to FIG. 2, the developing roller 302 includes a cylindrical sleeve 302*c*, a magnet roller 302*d*, and a rotary shaft 302*e*. Multiple magnets MG are circumferentially disposed on the magnet roller 302*d*. The sleeve 302*c* and the rotary shaft 302*e* are adapted to integrally rotate around the magnet roller 302*d*.

In this embodiment, the sleeve 302*c* is comprised of a nonmagnetic metal such as aluminum. The magnet roller 302*d* is static so that each of the magnets MG keeps facing a predetermined direction. In this embodiment, the magnet roller 302*d* is fixed to the casing 301. The developer 320 is attracted to the sleeve 302*c* by the magnets MG and is conveyed along with rotation of the sleeve 302*c*.

Figure 3:
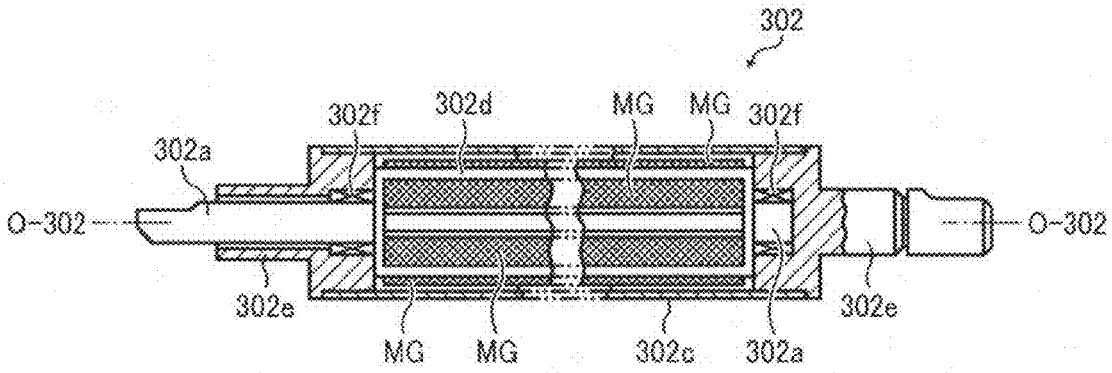
FIG. 3 is a cross-sectional view of the developing roller in an axial direction included in the developing device illustrated in FIG. 2.

FIG. 3 is a cross-sectional view of the developing roller 302 in an axial direction. The developing roller 302 includes a static shaft 302*a* fixed to the immovable casing 301, the magnet roller 302*d* integrated with the static shaft 302*a*, the sleeve 302*c* covering the magnet roller 302*d* while forming a gap therebetween, and the rotary shaft 302*e* integrated with the sleeve 302*c*. The rotary shaft 302*e* is rotatable relative to the static shaft 302*a* via bearings 302*f*. The rotary shaft 302*e* is driven to rotate upon transmission of power from a driver.

As illustrated in FIG. 3, the magnets MG are circumferentially disposed on the magnet roller 302*d* at a predetermined interval. The sleeve 302*c* is adapted to rotate around the magnets MG.

Each of the magnets MG forms a magnetic field to form or regulate ears of the developer 320 on the circumferential surface of the sleeve 302*c*. In particular, magnetic carrier particles in the developer 320 aggregate along normal magnetic field lines generated from the magnets MG. Thus, a magnetic brush is formed.

In the present embodiment illustrated in FIG. 2, the magnet roller 302*d* has three magnets MG. Thus, the magnet roller 302*d* generates a magnetic force distribution such that three magnetic poles exist. The first magnetic pole P1 (developing pole) exists on a line connecting the center O-302 of the developing roller 302 and the center O-1 of the photoreceptor 1. The first magnetic pole P1 exists over the developing area A. The second magnetic pole P2 (post-developing pole) and the third magnetic pole P3 (pre-developing pole) are disposed in this order relative to the direction of rotation of the developing roller 302.

In the present embodiment, the first, second, and, third magnetic poles P1, P2, and P3 employ north, south, and south poles, respectively. According to another embodiment, each of the magnetic poles may have the opposite polarity to the present embodiment. The pole P1 (developing pole) is facing the photoreceptor 1. The pole P2 (post-developing pole) is facing the casing 301 and the pole P3 (pre-developing pole) is facing the developer layer thickness regulator 303.

Figure 4:
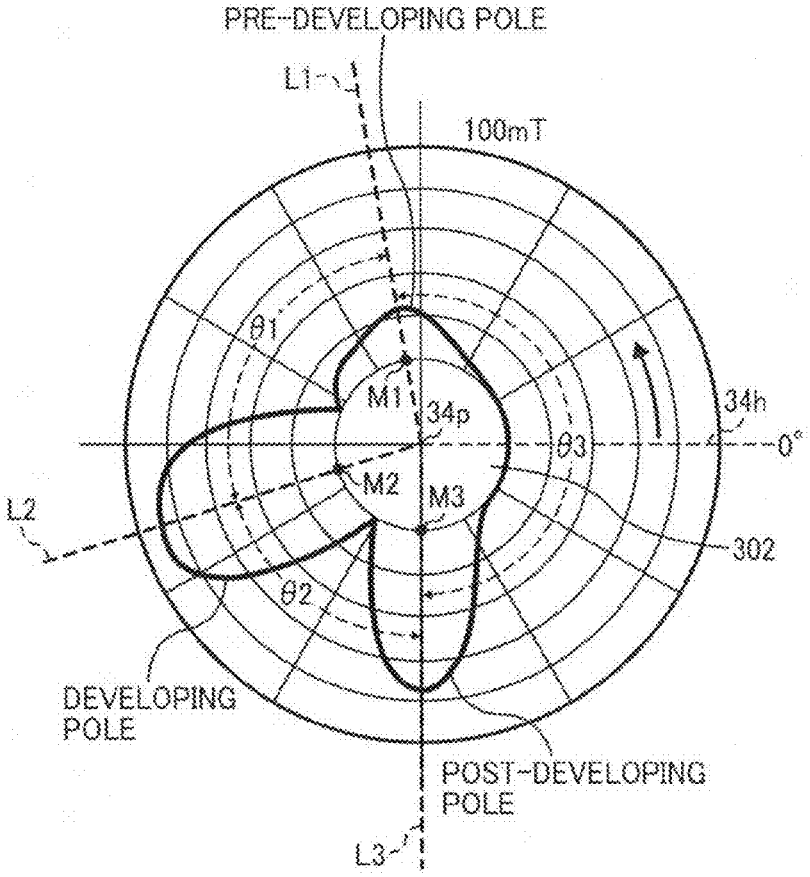
FIG. 4 is a graph showing a magnetic flux density distribution of the magnet roller included in the developing device illustrated in FIG. 2.

FIG. 4 is a graph showing a magnetic flux density distribution with respect to the developing roller 302.

The magnetic flux density distribution has three peaks in the normal direction to the surface of the developing roller 302 at the center position M1 of the pre-developing pole, the center position M2 of the developing pole, and the center position M3 of the post-developing pole. Dotted lines L1, L2, and L3 are connecting the rotation center 34*p* of the developing sleeve 302*c* with the center positions M1, M2, and M3, respectively.

An angle θ1 is formed between the dotted lines L1 and L2. An angle θ2 is formed between the dotted lines L2 and L3. An angle θ3 is formed between the dotted lines L3 and L1. A dotted line 34*h* represents a horizontal axis.

According to an embodiment, the post-developing pole (serving as a developer separating pole) and the pre-developing pole (serving as a developer supplying pole) are arranged so that the angle θ3 is 180° or more. In this case, the strength of a magnetic field generated between the post developing pole and the pre-developing pole is relatively small, which is advantageous for effectively separating developer from the developing roller.

Referring back to FIG. 2, in the developing area A, the developing roller 302 and the photoreceptor 1 are not in contact with each other while forming a predetermined developing gap GP therebetween.

The developer 320 forms ears on the developing roller 302 and the ears are brought into contact with the photoreceptor 1 so that toner particles in the developer 320 are adhered to an electrostatic latent image on the photoreceptor 1.

The static shaft 302*a* is connected to a grounded power source. The power source supplies a voltage to the sleeve 302*c* via the conductive rotary shaft 302*e* and the conductive bearings 302*f*. The undermost layer of the photoreceptor 1, i.e., the conductive support, is grounded.

In the developing area A, an electric field is formed so that toner particles separated from carrier particles migrate to the photoreceptor 1 due to the potential difference between the sleeve 302*c* and an electrostatic latent image formed on the photoreceptor 1.

The image forming apparatus illustrated in FIG. 1 employs a reversal developing method. In the reversal developing method, the photoreceptor 1 is negatively charged by the charger 2 and subsequently irradiated with the light L based on image information so that a portion corresponding to an image has a reduced surface potential, thus forming an electrostatic latent image. The electrostatic latent image is developed into a toner image by being supplied with negatively-charged toner particles. According to another embodiment, the polarities of the photoreceptor 1 and toner particles may be opposite to the present embodiment (i.e., positive).

As illustrated in FIG. 2, after the image development, the developer 320 on the developing roller 302 is conveyed downstream as the developing roller 302 rotates and is drawn into the casing 301 by the pole P2.

The poles P2 and P3 have the same polarity. The developer 320 cannot form ears on the developing roller 302 between the poles P2 and P3 due to their weak magnetic force. As a result, the developer 320 is separated from the developing roller 302 between the poles P2 and P3. Thus, as illustrated in FIG. 1, a developer separation area 9, in which the developer 320 is separated from the developing roller 302, is formed on the developing roller 302 between the poles P2 and P3. In the developer separation area 9, the magnetic force distribution curve has very short peaks.

The developer 320 served for the image development has a low toner concentration. In case this low-toner-concentration developer is conveyed to the developing area A again without being separated from the developing roller 302, the resulting toner image may have a low image density.

To prevent the above phenomena, the developer served for the image development is separated from the developing roller 302 in the developer separation area 9. The developer separated from the developing roller 302 is sufficiently agitated in the casing 301 so that the toner concentration and toner charge are adjusted.

The developer having the adjusted toner concentration and toner charge is fed to a developer retention space C by the supply chamber conveyer 304, as illustrated in FIG. 2.

The developer fed to the developer retention space C is then passed through the developer layer thickness regulator 303 disposed immediately below the peak of the pole P3. Thus, the developer is formed into a layer having a predetermined thickness on the developing roller 302 and conveyed to the developing area A while forming a magnetic brush. The pole P3 has a function of conveying the developer.

Figure 5:
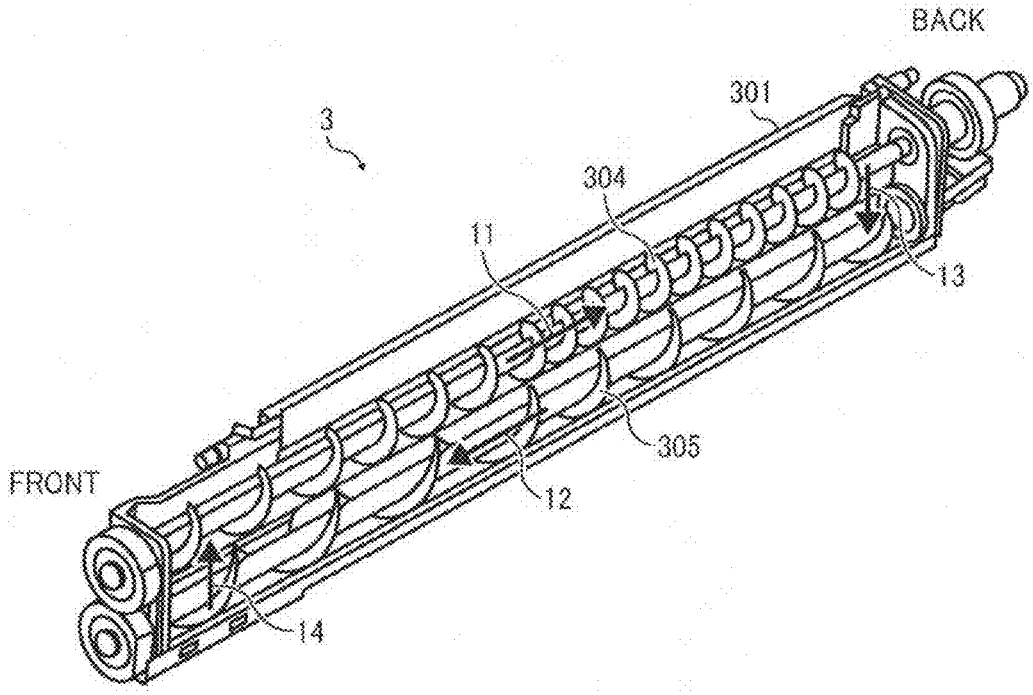
FIG. 5 and FIG. 6 are perspective views of the developing device illustrated in FIG. 2.
Figure 6:
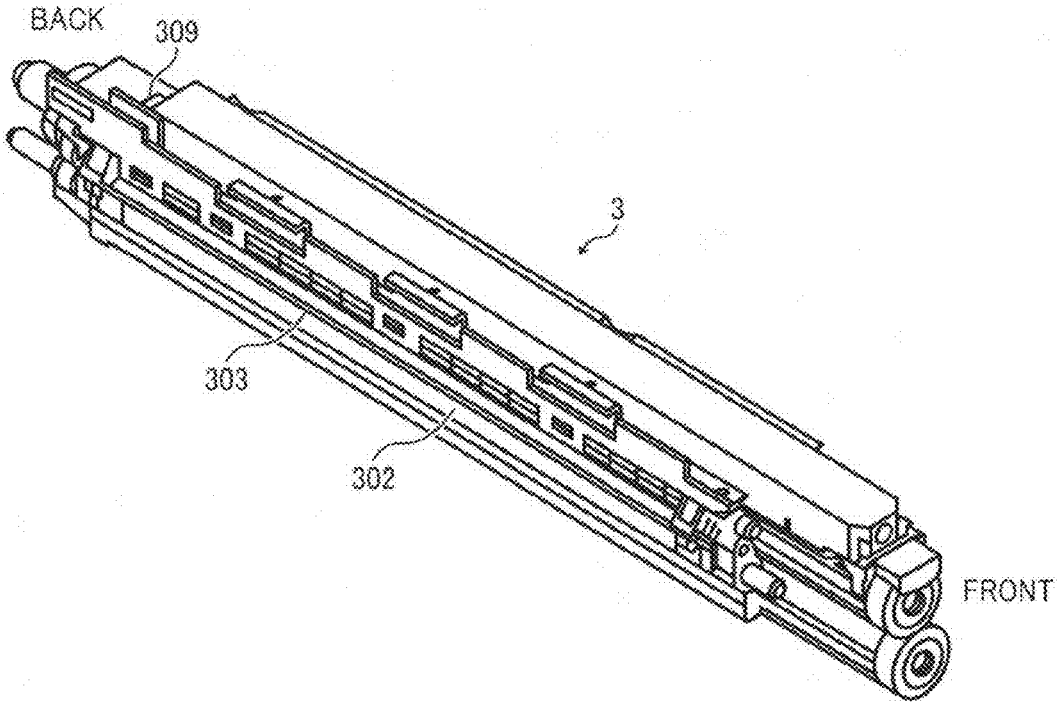

Referring to FIG. 1 and FIG. 2, the supply chamber conveyer 304 is disposed on a right upper side of the developing roller 302. In other words, the supply chamber conveyer 304 is disposed upstream from the developer layer thickness regulator 303. FIG. 5 and FIG. 6 are perspective views of the developing device 3. As illustrated in FIG. 5, the supply chamber conveyer 304 employs a screw having a spiral around the rotation axis. Referring back to FIG. 1, the supply chamber conveyer 304 rotates clockwise about its center line O-304 that is parallel to the center line O-302 of the developing roller 302. Thus, referring to FIG. 5, the supply chamber conveyer 304 conveys the developer from the front to the back in a longitudinal direction, as indicated by an arrow 11, while agitating the developer. The supply chamber conveyer 304 conveys the developer from the front to the back in an axial direction as it rotates.

Referring to FIG. 1 and FIG. 2, the collection chamber conveyer 305 is disposed on a right lower side of the developing roller 302 being adjacent to the developer separation area 9. As illustrated in FIG. 5, the collection chamber conveyer 305 employs a screw having a spiral around the rotation axis. Referring back to FIG. 1, the collection chamber conveyer 305 rotates counterclockwise about its center line O-305 that is parallel to the center line O-302 of the developing roller 302. Thus, referring to FIG. 5, the collection chamber conveyer 305 conveys the developer from the back to the front in a longitudinal direction, as indicated by an arrow 12, while agitating the developer. The collection chamber conveyer 305 conveys the developer from the back to the front in an axial direction as it rotates, which is opposite to the direction of conveyance of the supply chamber conveyer 304.

The supply chamber conveyer 304 is disposed above the collection chamber conveyer 305. A space around the supply chamber conveyer 304 and a space around the collection chamber conveyer 305 are disposed adjacent to each other within the casing 301.

The front ends of the supply chamber conveyer 304 and collection chamber conveyer 305 are both disposed anterior to the front end of the developing roller 302 so that the developer is reliably supplied to the front end of the developing roller 302. The back ends of the supply chamber conveyer 304 and collection chamber conveyer 305 are both disposed posterior to the back end of the developing roller 302 to make an enough space for supplying toner. The developer layer thickness regulator 303 has the same length as the developing roller 303 in a longitudinal direction.

Figure 7:
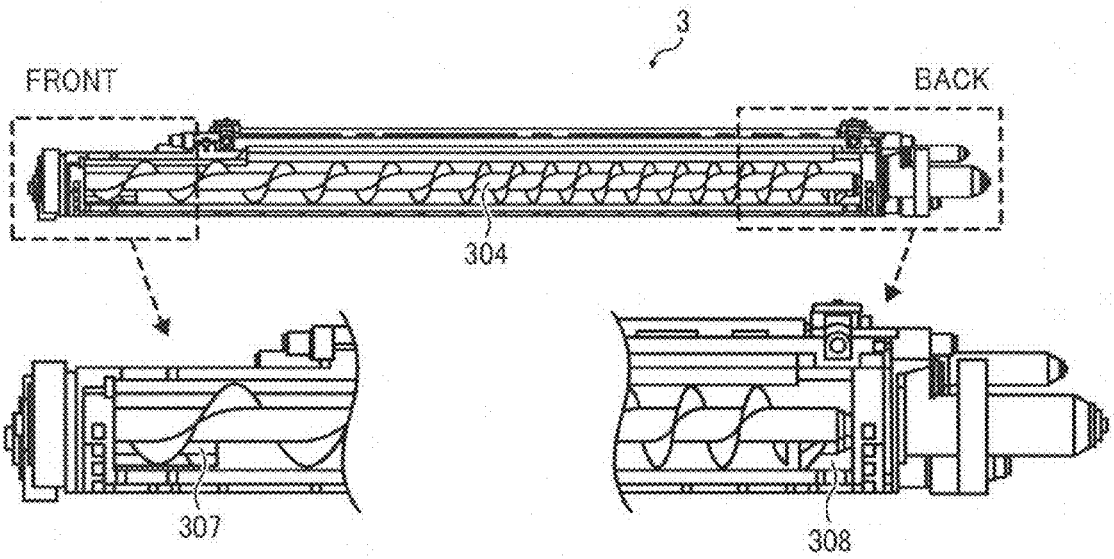
FIG. 7 is a lateral view of the developing device illustrated in FIG. 2.

A divider 306 is disposed in the casing 301 between the supply chamber conveyer 304 and the collection chamber conveyer 305. The divider 306 divides the space around the supply chamber conveyer 304 from the space around the collection chamber conveyer 305. FIG. 7 is a lateral view of the developing device 3. Communication apertures 307 and 308 are disposed on both ends of the divider 306.

Referring to FIG. 5 and FIG. 7, the developer conveyed in the direction indicated by the arrow 12 by the collection chamber conveyer 305 accumulates on the front end of the casing 301 and goes up through the communication aperture 307 as indicated by an arrow 14. The developer is then conveyed in the direction indicated by the arrow 11 by the supply chamber conveyer 304.

Similarly, referring to FIG. 5 and FIG. 7, the developer conveyed in the direction indicated by the arrow 11 by the supply chamber conveyer 304 accumulates on the back end of the casing 301 and goes down through the communication aperture 308 as indicated by an arrow 13. The developer is then conveyed in the direction indicated by the arrow 12 by the collection chamber conveyer 305 again.

Figure 8:
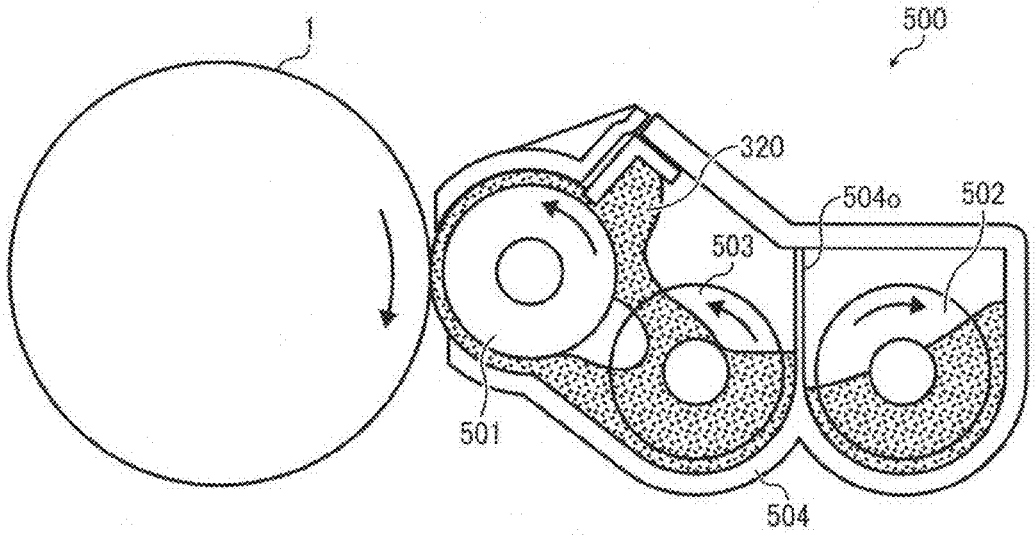
FIG. 8 RELATED ART
FIG. 8 is a schematic view illustrating a related art developing device.

The developing device 3 includes the developing roller 302, the supply chamber conveyer 304, the collection chamber conveyer 305, and the divider 306. The developing roller 302 is rotatable about its center line O-302, and is adapted to bear a developer to develop an electrostatic latent image on the photoreceptor 1 with the developer. The supply chamber conveyer 304 is rotatable about its center line O-304 that is parallel to the center line O-302 of the developing roller 302, and is adapted to convey the developer in a longitudinal direction while agitating the developer. The collection chamber conveyer 305 is rotatable about its center line O-305 that is parallel to the center line O-302 of the developing roller 302, and is adapted to convey the developer in a direction opposite to the direction of conveyance of the supply chamber conveyer 304 while agitating the developer. The collection chamber conveyer 305 is disposed adjacent to the developer separation area 9 in which the developer is separated from the developing roller 302. The divider 306, having communication apertures on both ends, is disposed between the supply chamber conveyer 304 and the collection chamber conveyer 305 to divide the space around the supply chamber conveyer 304 from the space around the collection chamber conveyer 305. Such a configuration forms a developer conveyance path through which the developer is conveyed as indicated by the arrows 11, 13, 12, and 14 within the casing 301. Thus, the developing device 3 has a configuration such that the supply chamber conveyer 304 and the collection chamber conveyer 305 are vertically disposed on a side of the developing roller 302, which is more compact in a horizontal direction compared to a related-art developing device 500 illustrated in FIG. 8 in which two conveyers 502 and 503 are horizontally disposed on a side of a developing roller 501. In FIG. 8, a numeral 1 denotes a photoreceptor, a numeral 500 denotes a developing device, a numeral 501 denotes a developing roller, a numeral 502 denotes a circulation screw, a numeral 503 denotes a supply screw, a numeral 504 denotes a developer container, a numeral 504*o* denotes a divider, and a numeral 320 denotes a developer.

Since the divider 306 divides the space around the supply chamber conveyer 304 from the space around the collection chamber conveyer 305, the developing roller 302 is supplied only with the developer 320 from the supply chamber conveyer 304, in which toner particles and carrier particles are well mixed and agitated. The developer served for the image development, having a low toner concentration, is conveyed by the collection chamber conveyer 305 but is not supplied to the developing roller 302. Thus, the developing roller 302 supplies only toner particles having a desired charge to an electrostatic latent image, thus providing a high-quality toner image.

Toner particles are consumed as the developer 320 is repeatedly served for the image development in the developing device 3. Therefore, the developing device 3 is externally supplied with supplemental toner particles. Referring to FIG. 6, supplemental toner particles are supplied from a supply opening 309 disposed adjacent to the back end of the developing device 3. Referring to FIG. 7, supplemental toner particles are supplied to a collection chamber through the communication aperture 308 without being directly served for the image development. The developer having a low toner concentration is mixed with the supplemental toner particles by the collection chamber conveyer 305 to have a predetermined toner concentration, and is thereafter served for the image development.

The collection chamber conveyer 305 is adapted only to collect the low-toner-concentration developer separated from the developing roller 302 and not to supply the developer to the developing roller 302. Therefore, the low-toner-concentration developer which is not yet sufficiently mixed with supplemental toner particles supplied from the supply opening 309 is never served for the image development.

The low-toner-concentration developer is sufficiently mixed with the supplemental toner particles by the collection chamber conveyer 305 to have a predetermined toner concentration before reaching the front end of the developing device 3. The developer adjusted to have a predetermined toner concentration then goes up and is conveyed to the back end of the developing device 3 by the supply chamber conveyer 304. Finally, the developer is supplied to the developing roller 302 and served for the image development.

A toner concentration detector is disposed on a lower part of the unit illustrated in FIG. 5. The toner concentration detector detects the carrier concentration (i.e., 100—toner concentration) in the developer by measuring magnetic permeability. The toner concentration detector determines the amount of supplemental toner particles to be supplied based on the detected carrier concentration.

The toner concentration detector is disposed on a downstream end of the developing device 3 relative to the direction of conveyance of the collection chamber conveyer 305.

Referring to FIG. 1 and FIG. 5, the developer is served for the image development before being conveyed to the back end by the supply chamber conveyer 304. Therefore, the greater amount of the developer is conveyed to the front end by the collection chamber conveyer 305 rather than to the back end by the supply chamber conveyer 304. Thus, the developer is likely to accumulate on the front end. Because the toner concentration detector is disposed on the downstream end relative to the direction of conveyance of the collection chamber conveyer 305 (i.e., the front end), the upper part of the toner concentration detector is always filled with the developer, thus providing reliable detection of the carrier concentration.

In the developing device 3 illustrated in FIG. 1, the developing roller 302 (i.e., the developer bearing member) has a ten-point average surface roughness Rz of 10 to 30 μm and the magnetic carrier particles have a ten-point average surface roughness Rz of 0.5 to 0.3 μm. In the developing device 3 illustrated in FIG. 1, the developer is supplied to the developing roller 302 from an upper side thereof. Therefore, the developer accumulating on the upper side of the developing roller 302 applies a pressure equivalent to its weight to those borne on the developing roller 302. At the same time, as illustrated in FIG. 5, the supply chamber conveyer 304 conveys the developer from the front to the back and the collection chamber conveyer 305 conveys the developer from the back to the front. Since the developer is collected from the developing roller 302 to the collection chamber conveyer 305, the amount of the developer borne on a front side of the developing roller 302 is greater than that borne on a back side of the developing roller 302. Thus, the developer borne on a front side of the developing roller 302 receives a greater pressure than that borne on a back side of the developing roller 302. Due to this pressure difference, it is likely that the developer forms ears more densely on a front side of the developing roller 302 and more sparsely on a back side of the developing roller 302. As a result, it is likely that the resulting solid and halftone images is lacking in uniformity. When the ten-point average surface roughness Rz of the developing roller 302 is 10 to 30 μm, supply of the developer to a front side of the developing roller 302 is suppressed while supply of the developer to a back side of the developing roller 302 is accelerated. Thus, developer ears are uniformly formed on the developing roller 302 and image having an even image density is produced. Additionally, when the ten-point average surface roughness Rz of the magnetic carrier particles is 0.5 to 3.0 μm, a constant amount of the developer is reliably supplied to the developing roller 302 while reducing impingement wear and improving lifespan of the developer.

Figure 9:
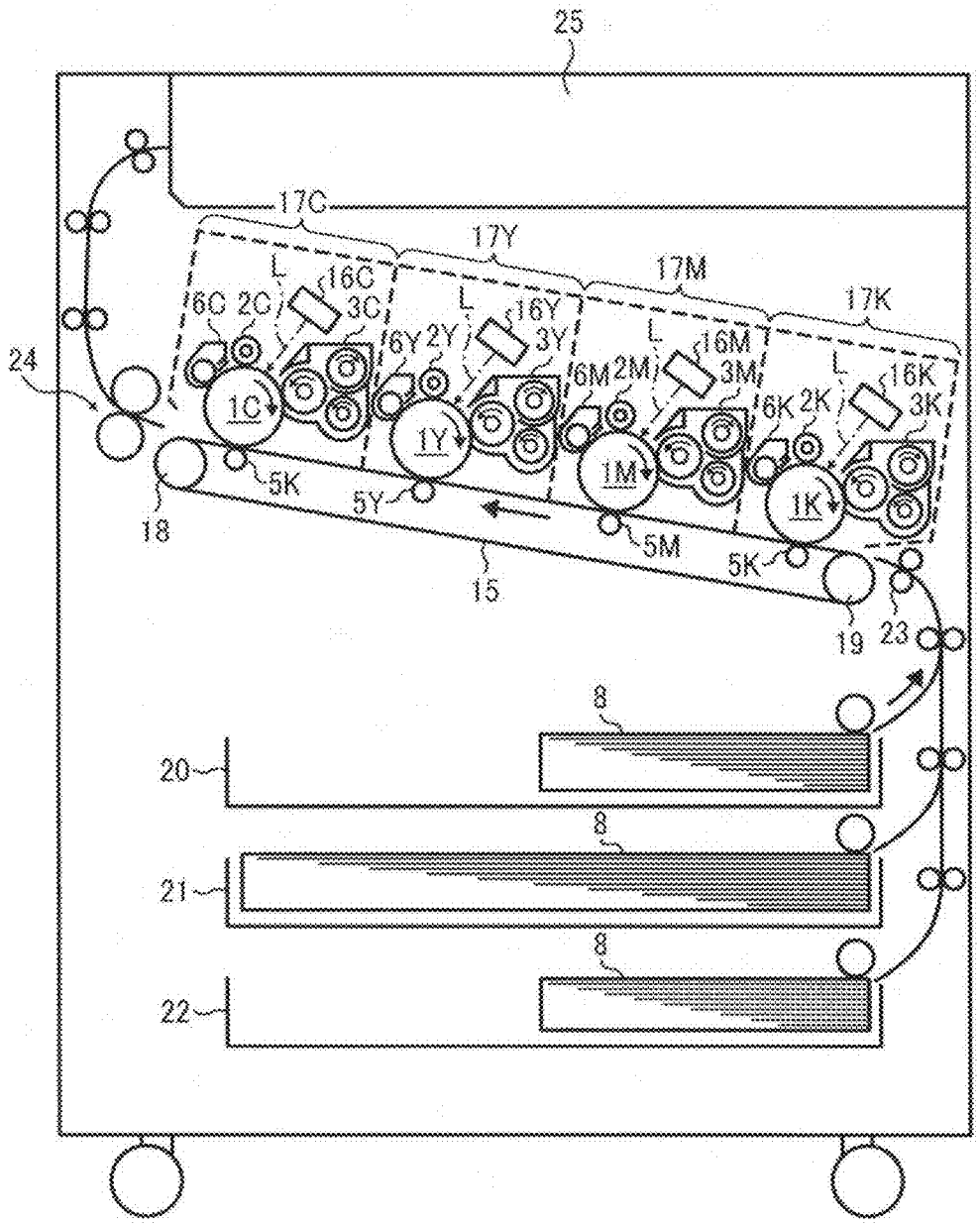
FIG. 9 is a schematic view illustrating a full-color tandem image forming apparatus according to an embodiment

FIG. 9 is a schematic view illustrating a full-color tandem image forming apparatus according to an embodiment.

The full-color tandem image forming apparatus includes a conveyer belt 15 adapted to convey a recording medium 8; and multiple image forming parts 17K, 17M, 17Y, and 17C tandemly disposed in this order along the conveyer belt 15 relative to the direction of conveyance of the conveyer belt 15. The additional characters K, M, Y, and C represent respective toner colors of black, magenta, yellow, and cyan. The arrangement order of the image forming parts is not limited to the above order. For example, according to another embodiment, the image forming parts 17M, 17C, 17Y, and 17K are tandemly disposed in this order.

Each of the image forming parts is comprised of multiple members. Each of the image forming parts is not necessarily formed into an independent unit. The image forming parts 17K, 17M, 17Y, and 17C have the same configuration except for containing different color toners of black, magenta, yellow, and cyan, respectively. For the above reason, in the following descriptions, only the image forming part 17K is described in detail. The same reference number will be given to identical constituent elements such as parts and materials having the same functions except for changing the additional characters and redundant descriptions thereof are omitted.

The endless conveyer belt 15 is rotatably supported by conveyer rollers 18 and 19, one of which is a driving roller and the other is a driven roller. The conveyer belt 15 is driven to rotate counterclockwise in FIG. 9 as the conveyer rollers 18 and 19 rotate. Paper feed trays 20, 21, and 22 each adapted to store sheets of the recording medium 8 are disposed below the conveyer belt 15.

A top sheet of the recording medium 8 stored in the paper feed tray 20 is conveyed to a registration roller 23. The registration roller 23 once stops feeding the sheet of the recording medium 8 (hereinafter simply "recording medium 8") and starts feeding it to the image forming part 17K in synchronization with an occurrence of image formation in the image forming part 17K. The recording medium 8 is fed to the first image forming part 17K while being electrostatically adsorbed to the conveyer belt 15. Consequently, a black toner image is transferred onto the recording medium 8.

The image forming part 17K includes a photoreceptor 1K, a charger 2K, a developing device 3K, and a cleaner 6K. A transfer device 5K is disposed facing the photoreceptor 1K with the conveyer belt 15 therebetween. The image forming part 17K further includes an optical scanning device 16K configured to emit light L to the photoreceptor 1K to write an electrostatic latent image thereon.

The charger 2K uniformly charges a surface of the photoreceptor 1K in darkness. The charged surface of the photoreceptor 1K is exposed to light L emitted from the optical scanning device 16K. Thus, an electrostatic latent image is formed on the photoreceptor 1K. The electrostatic latent image formed on the photoreceptor 1K is developed into a black toner image by the developing device 3K.

The black toner image is conveyed to the transfer position where the photoreceptor 1K faces the conveyer belt 15 as the photoreceptor 1K rotates. The transfer device 5K transfers the black toner image at the transfer position from the photoreceptor 1K onto the recording medium 8 on the conveyer belt 15. The cleaner 6K removes residual toner particles remaining on the surface of the photoreceptor 1K after the black toner image has been transferred from the photoreceptor 1K.

The recording medium 8 having the black toner image thereon is conveyed from the image forming part 17K to the next image forming part 17M by the conveyer belt 15. In the image forming part 17M, a magenta toner image is formed on a photoreceptor 17M and is transferred onto the black toner image on the recording medium 8.

The recording medium 8 is further conveyed to the next image forming part 17Y. In the image forming part 17Y, a yellow toner image is formed on a photoreceptor 1Y and is transferred onto the black and magenta toner images on the recording medium 8. Similarly, in the next image forming part 17C, a cyan toner image is further transferred onto the black, magenta, and yellow toner images on the recording medium 8.

The recording medium 8 having a composite full-color toner image is then separated from the conveyer belt 15 and conveyed to a fixing part 24. The composite full-color toner image is fixed on the recording medium 8 by passing a pair of fixing rollers in the fixing part 24, and finally discharged onto a discharge tray 25.

In the present embodiment, the photoreceptors 1K, 1M, 1Y, and 1C and corresponding developing devices 3K, 3M, 3Y, and 3C are substantially horizontally disposed. Since each of the developing devices 3K, 3M, 3Y, and 3C according to an embodiment is compact in a horizontal direction, it is possible to reduce intervals between the photoreceptors 1K, 1M, 1Y, and 1C, which results in provision of a compact tandem image forming apparatus.

Thus, the image forming apparatus according to an embodiment illustrated in FIG. 9 is more compact in the horizontal direction compared to the related-art image forming apparatus illustrated in FIG. 8. Because each of the developing devices 3K, 3M, 3Y, and 3C has the developer separation area, developer supply area, supply chamber conveyer 304, collection chamber conveyer 305, and divider 306, toner particles are reliably charged and produce high-quality image. Such a configuration also prevents deterioration of the toner particles. Thus, a developing device having long lifespan and high durability is provided. The developing device according to an embodiment is also applicable to a monochrome image forming apparatus.

A process cartridge according to an embodiment includes at least an electrostatic latent image bearing member and a developing device adapted to develop an electrostatic latent image formed on the electrostatic latent image bearing member into a toner image with a two-component developer. The developing device is that according to an embodiment. The process cartridge is detachably mountable to any image forming apparatus.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Measurement of Ten-Point Average Surface Roughness Rz of Developer Bearing Member The ten-point average surface roughness Rz of the developer bearing member was measured by an instrument SURFCORDER SE-30H (from Kosaka Laboratory Ltd.) under the following measuring conditions.

Longitudinal magnification: 2,000 times
Transverse magnification: 2.5 times
Measuring length: 25 mm
Measuring speed: 2.0 mm/sec
Cutoff: fh 0.8 mm, fl 2.5 mm Measurement of Ten-Point Average Surface Roughness Rz of Magnetic Carrier Particles The ten-point average surface roughness Rz of the magnetic carrier particle was measured by a confocal microscope (OPTELICS® C130 from Lasertec Corporation) by analyzing the three-dimensional structure of the surface of the magnetic carrier particle under the following measuring conditions. More specifically, Rz was determined by measuring a height curve of the surface of the magnetic carrier particle within a specified range and determine the center line, summing the absolute deviations of the measured height curve from the center line, and averaging the sum.

Objective lens magnification: 50 times
Resolution: 0.20
Analysis: Averaging Rz obtained from randomly selected 20 specified ranges (10 μm×10 μm) per sample.

Measurement of Average Thickness h of Covering Layer of Magnetic Carrier Particles The thickness h of the covering layer of the magnetic carrier particle was determined by observing a cross-section of the magnetic carrier particles using a transmission electron microscope (TEM). In particular, the thickness h was determined only from the thicknesses of the binder resin portions lying between a surface portion of the core particle and each conductive fine particle. Binder resin portions which were lying between two conductive fine particles or those which were lying between a surface portion of the covering layer and a conducive particle were not taken into consideration. Specifically, the thickness h was the average thickness among 50 randomly-selected portions of the covering layer observed in the cross-section of the magnetic carrier particle.

Measurement of Volume Average Particle Diameter D of Conductive Fine Particles in Covering Layer of Magnetic Carrier Particles The volume average particle diameter D of the conductive fine particles was determined by an automatic particle size distribution analyzer CAPA-700 (from Horiba, Ltd.) as follows. First, fill a juicer mixer with 30 mL of an aminosilane (SH6020 from Dow Corning Toray Co., Ltd.) and 300 ml of a toluene solution. Add 6.0 mg of a sample thereto and disperse the sample for 3 minutes while setting the rotation speed of the mixer to a level "low". Add several drops of the resulting dispersion to 500 ml of a toluene solution contained in a 1,000-ml beaker to dilute the dispersion. Keep agitating the diluted dispersion with a homogenizer. Subject the diluted dispersion to a measurement by the automatic particle size distribution analyzer CAPA-700 (from Horiba, Ltd.) under the following measurement conditions.

Rotation speed: 2,000 rpm
Maximum particle size: 2.0 μm
Minimum particle size: 0.1 μm
Particle size interval: 0.1 μm
Dispersion medium viscosity: 0.59 mPa·s
Dispersion medium density: 0.87 g/cm$^3$
Particle density: Input an absolute specific gravity measured by a micromeritics gas pycnometer Accupyc 1330 (from Shimadzu Corporation).

Preparation of Carrier 1

A covering layer liquid was prepared by dispersing 51.3 parts of an acrylic resin solution (HITALOID 3001 from Hitachi Chemical Co., Ltd., having a solid content of 50%), 14.6 parts of a guanamine solution (MYCOAT 106 from MT AquaPolymer, Inc., having a solid content of 70%), 0.29 parts of an acidic catalyst (TC-750 from Matsumoto Fine Chemical Co., Ltd., having a solid content of 40%), 648 parts of a silicone resin solution (SR2410 from Dow Corning Toray Co., Ltd., having a solid content of 20%), 3.2 parts of an aminosilane (SH6020 from Dow Corning Toray Co., Ltd., having a solid content of 100%), 165 parts of conductive fine particles (EC-500 from Titan Kogyo, Ltd. that are titanium oxide particles surface-treated with antimony-doped indium oxide having an average particle diameter of 0.43 μm and an absolute specific gravity of 4.6), and 1,800 parts of toluene, for 10 minutes using a HOMOMIXER. The covering layer liquid was applied to the surfaces of 5,000 parts of Mn ferrite particles having an average particle diameter of 35 μm using a SPIRA COTA (from Okada Seiko Co., Ltd.) at an inner temperature of 55° C., followed by drying, so that the resulting covering layer had a thickness of 0.55 μm. The ferrite particles having the covering layer were burnt in an electric furnace for 1 hour at 200° C. The resulting bulk of the ferrite particles was then pulverized with a sieve having openings of 63 μm. Thus, a carrier 1 was prepared.

The carrier 1 had a D/h of 0.8 and a ten-point average surface roughness Rz of 2.0 μm.

Preparation of Carrier 2

The procedure for preparing the carrier 1 was repeated expect that the content of the conductive fine particles (EC-500) in the covering layer liquid was changed to 170 parts and the covering layer was formed to have an average thickness of 0.48 μm. Thus, a carrier 2 was prepared.

The carrier 2 had a D/h of 0.9 and a ten-point average surface roughness Rz of 2.3 μm.

Preparation of Carrier 3

The procedure for preparing the carrier 1 was repeated expect that the content of the conductive fine particles (EC-500) in the covering layer liquid was changed to 160 parts and the covering layer was formed to have an average thickness of 0.61 μm. Thus, a carrier 3 was prepared.

The carrier 3 had a D/h of 0.7 and a ten-point average surface roughness Rz of 1.7 μm.

Preparation of Carrier 4

The procedure for preparing the carrier 1 was repeated expect that the content of the conductive fine particles (EC-500) in the covering layer liquid was changed to 150 parts and the covering layer was formed to have an average thickness of 0.86 μm. Thus, a carrier 4 was prepared.

The carrier 4 had a D/h of 0.5 and a ten-point average surface roughness Rz of 0.5 μm.

Preparation of Carrier 5

The procedure for preparing the carrier 1 was repeated expect that the content of the conductive fine particles (EC-500) in the covering layer liquid was changed to 180 parts and the covering layer was formed to have an average thickness of 0.39 μm. Thus, a carrier 5 was prepared.

The carrier 5 had a D/h of 1.1 and a ten-point average surface roughness Rz of 3.0 μm.

Preparation of Carrier 6

The procedure for preparing the carrier 1 was repeated expect that the content of the conductive fine particles (EC-500) in the covering layer liquid was changed to 145 parts and the covering layer was formed to have an average thickness of 1.1 μm. Thus, a carrier 6 was prepared.

The carrier 6 had a D/h of 0.4 and a ten-point average surface roughness Rz of 0.35 μm.

Preparation of Carrier 7

The procedure for preparing the carrier 1 was repeated expect that the content of the conductive fine particles (EC-500) in the covering layer liquid was changed to 185 parts and the covering layer was formed to have an average thickness of 0.36 μm. Thus, a carrier 7 was prepared.

The carrier 7 had a D/h of 1.2 and a ten-point average surface roughness Rz of 3.1 μm.

Properties of the above-prepared carriers are shown in Table 1.

TABLE 1

| Carrier No. | Volume Average Particle Diameter D (μm) of Conductive Fine Particles | Average Thickness h (μm) of Covering Layer | D/h | Ten-point Average Surface Roughness Rz (μm) |
|---|---|---|---|---|
| 1 | 0.43 | 0.55 | 0.8 | 2.0 |
| 2 | 0.43 | 0.48 | 0.9 | 2.3 |
| 3 | 0.43 | 0.61 | 0.7 | 1.7 |
| 4 | 0.43 | 0.86 | 0.5 | 0.5 |
| 5 | 0.43 | 0.39 | 1.1 | 3.0 |
| 6 | 0.43 | 1.1 | 0.4 | 0.35 |
| 7 | 0.43 | 0.36 | 1.2 | 3.1 |

Preparation of Toner 1

Preparation of Polyester Resin A

A reaction vessel equipped with a condenser, a stirrer, and a nitrogen inlet pipe was charged with 65 parts of ethylene oxide 2 mol adduct of bisphenol A, 86 parts of propylene oxide 3 mol adduct of bisphenol A, 274 parts of terephthalic acid, and 2 parts of dibutyltin oxide. The mixture was subjected to a reaction for 15 hours at 230° C. under normal pressures. The mixture was further subjected to a reaction for 6 hours under reduced pressures of 5 to 10 mmHg. Thus, a polyester resin A was prepared.

The polyester resin A had a number average molecular weight (Mn) of 2,300, a weight average molecular weight (Mw) of 8,000, a glass transition temperature (Tg) of 58° C., an acid value of 25 mgKOH/g, and a hydroxyl value of 35 mgKOH/g.

Preparation of Prepolymer

A reaction vessel equipped with a condenser, a stirrer, and a nitrogen inlet pipe was charged with 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide. The mixture was subjected to a reaction for 8 hours at 230° C. under normal pressures. The mixture was further subjected to a reaction for 5 hours under reduced pressures of 10 to 15 mmHg. Thus, an intermediate polyester was prepared.

The intermediate polyester had a number average molecular weight (Mn) of 2,100, a weight average molecular weight (Mw) of 9,600, a glass transition temperature (Tg) of 55° C., an acid value of 0.5 mgKOH/g, and a hydroxyl value of 49 mgKOH/g.

Another reaction vessel equipped with a condenser, a stirrer, and a nitrogen inlet pipe was charged with 411 parts of the intermediate polyester, 89 parts of isophorone diisocyanate, and 500 parts of ethyl acetate. The mixture was subjected to a reaction for 5 hours at 100° C. Thus, a prepolymer was prepared.

The prepolymer had a free isocyanate content of 1.60% and a solid content of 50% (after being left for 45 minutes at 150° C.).

Preparation of Ketimine Compound

A reaction vessel equipped with a stirrer and a thermometer was charged with 30 parts of isophoronediamine and 70 parts of methyl ethyl ketone. The mixture was subjected to a reaction for 5 hours at 50° C. Thus, a ketimine compound was prepared. The ketimine compound had an amine value of 423.

Preparation of Master Batch

First, 1,000 parts of water, 540 parts of a carbon black (PRINTEX 35 from Degussa, having a DBP oil absorption of 42 mL/100 g and a pH of 9.5), and 1,200 parts of the polyester resin A were mixed using a HENSCHEL MIXER (from Mitsui Mining and Smelting Co., Ltd.). The resulting mixture was kneaded for 30 minutes at 150° C. using double rolls, the kneaded mixture was then rolled and cooled, and the rolled mixture was then pulverized into particles using a pulverizer (from Hosokawa Micron Corporation). Thus, a master batch was prepared.

Preparation of Aqueous Medium

An aqueous medium was prepared by mixing and agitating 306 parts of ion-exchange water, 265 parts of a 10% suspension of tricalcium phosphate, and 1.0 part of sodium dodecylbenzenesulfonate.

Preparation of Toner Components Liquid

In a beaker, 70 parts of the polyester resin A and 10 parts of the prepolymer were dissolved in 100 parts of ethyl acetate. Further, 5 parts of a paraffin wax (HNP-9 from Nippon Seiro Co., Ltd., having a melting point of 75° C.), 2 parts of a methyl ethyl ketone dispersion of a colloidal silica (MEK-ST from Nissan Chemical Industries, Ltd., having a solid content of 30%), and 10 parts of the master batch were added to the beaker. The resulting mixture was subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 msec. This dispersing operation was repeated 3 times (3 passes). Thereafter, 2.7 parts of the ketimine compound were further added to the mixture. Thus, a toner components liquid was prepared.

Preparation of Emulsion Slurry

While agitating 150 parts of the aqueous medium in a vessel at a revolution of 12,000 rpm using a TK HOMOMIXER (from PRIMIX Corporation), 100 parts of the toner components liquid were mixed therein for 10 minutes. Thus, an emulsion slurry was prepared.

Removal of Organic Solvent

A flask equipped with a stirrer and a thermometer was charged with 100 parts of the emulsion slurry. The emulsion slurry was agitated for 12 hours at 30° C. at a peripheral speed of 20 m/min so that the organic solvents were removed therefrom. Thus, a dispersion slurry was prepared.

Washing

First, 100 parts of the dispersion slurry was filtered under reduced pressures, and mixed with 100 parts of ion-exchange water using a TK HOMOMIXER for 10 minutes at a revolution of 12,000 rpm, followed by filtering, thus obtaining a wet cake (i). The wet cake (i) was mixed with 300 parts of ion-exchange water using a TK HOMOMIXER for 10 minutes at a revolution of 12,000 rpm, followed by filtering. This operation was repeated twice, thus obtaining a wet cake (ii). The wet cake (ii) was mixed with 20 parts of a 10% aqueous solution of sodium hydroxide using a TK HOMOMIXER for 30 minutes at a revolution of 12,000 rpm, followed by filtering under reduced pressures, thus obtaining a wet cake (iii). The wet cake (iii) was mixed with 300 parts of ion-exchange water using a TK HOMOMIXER for 10 minutes at a revolution of 12,000 rpm, followed by filtering, thus obtaining a wet cake (iv). The wet cake (iv) was mixed with 300 parts of ion-exchange water using a TK HOMOMIXER for 10 minutes at a revolution of 12,000 rpm, followed by filtering. This operation was repeated twice, thus obtaining a wet cake (v). The wet cake (v) was mixed with 20 parts of a 10% hydrochloric acid using a TK HOMOMIXER for 10 minutes at a revolution of 12,000 rpm, followed by filtering, thus obtaining a wet cake (vi).

The wet cake (vi) was mixed with 300 parts of ion-exchange water using a TK HOMOMIXER for 10 minutes at a revolution of 12,000 rpm. The resulting dispersion was subjected to a measurement of electric conductivity to determine the surfactant concentration referring to the calibration curve previously compiled. The dispersion was supplied with additional ion-exchange water so that the surfactant concentration becomes 0.05% by weight. Thus, a toner dispersion was prepared.

Surface Treatment

The above-prepared toner dispersion having a predetermined surfactant concentration was heated to 55° C. (T1) in a water bath for 10 hours while being agitated by a TK HOMOMIXER at a revolution of 5,000 rpm. Thereafter, the toner dispersion was cooled to 25° C. and filtered. The filtered cake was mixed with 300 parts of ion-exchange water using a TK HOMOMIXER for 10 minutes at a revolution of 12,000 rpm, followed by filtering.

Drying

The cake thus obtained was dried by a drier for 48 hours at 45° C. and filtered with a mesh having openings of 75 μm. Thus, a mother toner 1 was prepared.

External Treatment

The mother toner 1 in an amount of 100 parts was mixed with 0.6 parts of a hydrophobized silica having an average particle diameter of 100 nm, 1.0 part of a titanium oxide having an average particle diameter of 20 nm, and 0.8 parts of a hydrophobized silica powder having an average particle diameter of 15 nm using a HENSCHEL MIXER. Thus, a toner 1 was prepared.

Preparation of Developer

A developer 1 was prepared by mixing 7 parts of the toner 1 and 93 parts of the carrier 1. The developer 1 had a bulk density of 1.73 g/cm$^3$.

Example 1

The image forming apparatus illustrated in FIG. 9 including the developing device illustrated in FIG. 1 was charged with the developer 1.

The developing device had a stainless-steel developer bearing member (for use in IMAGIO COLOR 4000 from Ricoh Co., Ltd.) having a diameter of 12 mm, the ten-point average surface roughness Rz of which had been adjusted to 20 μm by sandblasting.

A running test in which a monochrome image chart having an image area ratio of 20% was continuously formed on 200,000 sheets of paper was performed by the image forming apparatus. After the running test, the produced image was evaluated in terms of image density unevenness in both solid and halftone images, ear marks, developer depletion, background fouling, and carrier scattering. The evaluation results are shown in Table 3.

Image Density Unevenness in Solid Image

A solid image was produced on a A3-size paper after the running test and visually observed to evaluate the degree of image density unevenness. The degree of image density unevenness was graded into the following five levels.

◎: Image density unevenness was not observed.

○: Slight image density unevenness was observed.

Δ: Image density unevenness was observed.

x: Considerable image density unevenness was observed.

xx: Apparent image density unevenness was observed.

The grades ◎, ○, and Δ are commercially viable and the grades x and xx are commercially unviable.

Image Density Unevenness in Halftone Image

A halftone image was produced on an A3-size paper after the running test and visually observed to evaluate the degree of image density unevenness. The degree of image density unevenness was graded into the following five levels.

◎: Image density unevenness was not observed.

○: Slight image density unevenness was observed.

Δ: Image density unevenness was observed.

x: Considerable image density unevenness was observed.

xx: Apparent image density unevenness was observed.

The grades ◎, ○, and Δ are commercially viable and the grades x and xx are commercially unviable.

Ear Marks

The solid image produced after the running test was also visually observed to determine whether undesired marks were made or not by the ears of the magnetic brush (hereinafter "ear mark"). The degree of the ear marks was graded into the following four levels.

◎: No ear mark was observed.

○: Ear marks were slightly observed.

Δ: Ear marks were considerably observed.

x: Ear marks were apparently observed.

The grades ◎ and ○ are commercially viable and the grades Δ and x are commercially unviable.

Developer Depletion

During the running test, the produced images at every 100 sheets were visually observed to determine whether the image density at an area having a width of 5 cm from an edge of a side equivalent to the front side of the developing device was decreased or not. The degree of developer depletion was evaluated in terms of the image density and graded into the following four levels.

◎: No image had a decreased image density.

○: Two or less images out of 100 images had a slightly decreased image density.

Δ: Two or less images out of 100 images had a considerably decreased image density.

x: Two or more images out of 100 images had a considerably decreased image density.

The grades ◎ and ○ are commercially viable and the grades Δ and x are commercially unviable.

Background Fouling

The degree of background fouling was determined by quantifying toner particles present on the photoreceptor during development of a white solid image after the running test. Specifically, the development procedure of a white solid image was interrupted and toner particles present on the photoreceptor were transferred onto a tape (PRINTAC from Nitto Denko Corporation). The tape having the toner particles was subjected to a measurement of image density by a 938 spectrodensitometer (from X-Rite). The image density difference (ΔID) between the blank tape and the tape having the toner particles was graded into the following four levels. The smaller the ΔID, the better the degree of background fouling.

◎: ΔID was less than 0.005.

○: ΔID was not less than 0.005 and less than 0.01.

Δ: ΔID was not less than 0.01 and less than 0.02.

x: ΔID was not less than 0.02.

The grades ◎ and ○ are commercially viable and the grades Δ and x are commercially unviable.

Carrier Scattering

After the running test, a solid image was produced on an A3-size paper while breaking the current to the conveyance belt and visually observed to measure the number of white spots generated due to the occurrence of carrier scattering. The degree of carrier scattering was graded into the following five levels.

◎: The number of white spots was less than 50.

○: The number of white spots was not less than 50 and less than 200.

Δ: The number of white spots was not less than 200 and less than 400.

x: The number of white spots was not less than 400.

The grades ◎ and ○ are commercially viable and the grades Δ and x are commercially unviable.

Example 2

The procedure in Example 1 was repeated except for replacing the developer 1 with a developer 2 prepared by mixing 93 parts of the carrier 2 and 7 parts of the toner 1. The evaluation results are shown in Table 3.

Example 3

The procedure in Example 1 was repeated except for replacing the developer 1 with a developer 3 prepared by mixing 93 parts of the carrier 3 and 7 parts of the toner 1. The evaluation results are shown in Table 3.

Example 4

The procedure in Example 1 was repeated except for replacing the developer 1 with a developer 4 prepared by mixing 93 parts of the carrier 4 and 7 parts of the toner 1 and replacing the developer bearing member with another developer bearing member having a ten-point average surface roughness Rz of 10 μm obtained by controlling sandblast processing time. The evaluation results are shown in Table 3.

Example 5

The procedure in Example 1 was repeated except for replacing the developer 1 with a developer 4 prepared by mixing 93 parts of the carrier 4 and 7 parts of the toner 1 and replacing the developer bearing member with another developer bearing member having a ten-point average surface roughness Rz of 30 μm obtained by controlling sandblast processing time. The evaluation results are shown in Table 3.

Example 6

The procedure in Example 1 was repeated except for replacing the developer 1 with a developer 5 prepared by mixing 93 parts of the carrier 5 and 7 parts of the toner 1 and replacing the developer bearing member with another developer bearing member having a ten-point average surface roughness Rz of 10 μm obtained by controlling sandblast processing time. The evaluation results are shown in Table 3.

Example 7

The procedure in Example 1 was repeated except for replacing the developer 1 with a developer 5 prepared by mixing 93 parts of the carrier 5 and 7 parts of the toner 1 and replacing the developer bearing member with another developer bearing member having a ten-point average surface roughness Rz of 30 μm obtained by controlling sandblast processing time. The evaluation results are shown in Table 3.

Example 8

The procedure in Example 1 was repeated except for replacing the developer 1 with a developer 4 prepared by mixing 93 parts of the carrier 4 and 7 parts of the toner 1. The evaluation results are shown in Table 3.

Example 9

The procedure in Example 1 was repeated except for replacing the developer 1 with a developer 5 prepared by mixing 93 parts of the carrier 5 and 7 parts of the toner 1. The evaluation results are shown in Table 3.

Comparative Example 1

The procedure in Example 1 was repeated except for replacing the developer 1 with a developer 4 prepared by mixing 93 parts of the carrier 4 and 7 parts of the toner 1 and replacing the developer bearing member with another developer bearing member having a ten-point average surface roughness Rz of 9 μm obtained by controlling sandblast processing time. The evaluation results are shown in Table 3.

Comparative Example 2

The procedure in Example 1 was repeated except for replacing the developer 1 with a developer 5 prepared by mixing 93 parts of the carrier 5 and 7 parts of the toner 1 and replacing the developer bearing member with another developer bearing member having a ten-point average surface roughness Rz of 9 μm obtained by controlling sandblast processing time. The evaluation results are shown in Table 3.

Comparative Example 3

The procedure in Example 1 was repeated except for replacing the developer 1 with a developer 4 prepared by mixing 93 parts of the carrier 4 and 7 parts of the toner 1 and replacing the developer bearing member with another developer bearing member having a ten-point average surface roughness Rz of 31 μm obtained by controlling sandblast processing time. The evaluation results are shown in Table 3.

Comparative Example 4

The procedure in Example 1 was repeated except for replacing the developer 1 with a developer 5 prepared by mixing 93 parts of the carrier 5 and 7 parts of the toner 1 and replacing the developer bearing member with another developer bearing member having a ten-point average surface roughness Rz of 31 μm obtained by controlling sandblast processing time. The evaluation results are shown in Table 3.

Comparative Example 5

The procedure in Example 1 was repeated except for replacing the developer 1 with a developer 6 prepared by mixing 93 parts of the carrier 6 and 7 parts of the toner 1 and replacing the developer bearing member with another developer bearing member having a ten-point average surface roughness Rz of 10 μm obtained by controlling sandblast processing time. The evaluation results are shown in Table 3.

Comparative Example 6

The procedure in Example 1 was repeated except for replacing the developer 1 with a developer 6 prepared by mixing 93 parts of the carrier 6 and 7 parts of the toner 1 and replacing the developer bearing member with another developer bearing member having a ten-point average surface roughness Rz of 30 μm obtained by controlling sandblast processing time. The evaluation results are shown in Table 3.

Comparative Example 7

The procedure in Example 1 was repeated except for replacing the developer 1 with a developer 7 prepared by mixing 93 parts of the carrier 7 and 7 parts of the toner 1 and replacing the developer bearing member with another developer bearing member having a ten-point average surface roughness Rz of 10 μm obtained by controlling sandblast processing time. The evaluation results are shown in Table 3.

Comparative Example 8

The procedure in Example 1 was repeated except for replacing the developer 1 with a developer 7 prepared by mixing 93 parts of the carrier 7 and 7 parts of the toner 1 and replacing the developer bearing member with another developer bearing member having a ten-point average surface roughness Rz of 30 μm obtained by controlling sandblast processing time. The evaluation results are shown in Table 3.

Details of the above Examples are shown in Table 2. The evaluation results are shown in Table 3.

TABLE 2

| | Carrier No. | Developer No. | Ten-point Average Surface Roughness Rz (μm) of Developer Bearing Member | Ten-point Average Surface Roughness Rz (μm) of Carrier | D/h | Average Thickness h (μm) of Covering Layer of Carrier |
|---|---|---|---|---|---|---|
| Example 1 | 1 | 1 | 20 | 2.0 | 0.8 | 0.55 |
| Example 2 | 2 | 2 | 20 | 2.3 | 0.9 | 0.48 |
| Example 3 | 3 | 3 | 20 | 1.7 | 0.7 | 0.61 |
| Example 4 | 4 | 4 | 10 | 0.5 | 0.5 | 0.86 |
| Example 5 | 4 | 4 | 30 | 0.5 | 0.5 | 0.86 |
| Example 6 | 5 | 5 | 10 | 3.0 | 1.1 | 0.39 |
| Example 7 | 5 | 5 | 30 | 3.0 | 1.1 | 0.39 |
| Example 8 | 4 | 4 | 20 | 0.5 | 0.5 | 0.86 |
| Example 9 | 5 | 5 | 20 | 3.0 | 1.1 | 0.39 |
| Comparative Example 1 | 4 | 4 | 9 | 0.5 | 0.5 | 0.86 |
| Comparative Example 2 | 5 | 5 | 9 | 3.0 | 1.1 | 0.39 |
| Comparative Example 3 | 4 | 4 | 31 | 0.5 | 0.5 | 0.86 |
| Comparative Example 4 | 5 | 5 | 31 | 3.0 | 1.1 | 0.39 |
| Comparative Example 5 | 6 | 6 | 10 | 0.35 | 0.4 | 1.1 |
| Comparative Example 6 | 6 | 6 | 30 | 0.35 | 0.4 | 1.1 |
| Comparative Example 7 | 7 | 7 | 10 | 3.1 | 1.2 | 0.36 |
| Comparative Example 8 | 7 | 7 | 30 | 3.1 | 1.2 | 0.36 |

TABLE 3

| | Image Density Unevenness in Solid Image | Image Density Unevenness in Halftone Image | Ear Marks | Developer Depletion | Background Fouling | Carrier Scattering |
|---|---|---|---|---|---|---|
| Example 1 | ◎ | ◎ | ◎ | ◎ | ◎ | ◎ |
| Example 2 | ◎ | ◎ | ○ | ◎ | ◎ | ◎ |
| Example 3 | ◎ | ◎ | ◎ | ◎ | ◎ | ○ |
| Example 4 | ○ | ○ | ○ | ○ | ◎ | ◎ |
| Example 5 | ○ | ○ | ○ | ○ | ◎ | ◎ |
| Example 6 | ○ | ○ | ○ | ○ | ◎ | ○ |
| Example 7 | ○ | ○ | ○ | ○ | ◎ | ○ |
| Example 8 | ○ | ○ | ○ | ○ | ◎ | ◎ |
| Example 9 | ○ | ○ | ○ | ○ | ◎ | ○ |
| Comparative Example 1 | X | X | X | Δ | ◎ | ◎ |
| Comparative Example 2 | X | X | X | Δ | ◎ | ○ |
| Comparative Example 3 | X | X | X | X | ◎ | ◎ |
| Comparative Example 4 | X | X | X | X | ◎ | ○ |
| Comparative Example 5 | X | X | ○ | ○ | ◎ | ◎ |
| Comparative Example 6 | X | X | ○ | ○ | ◎ | ◎ |
| Comparative Example 7 | ○ | ○ | ○ | ○ | ◎ | X |
| Comparative Example 8 | ○ | ○ | ○ | ○ | ◎ | X |

Additional modifications and variations in accordance with further embodiments of the present invention are possible in light of the above teachings. It is therefore to be understood that within the scope of the appended claims the invention may be practiced other than as specifically described herein.

What is claimed is:

1. A developing device, comprising:

a developer container, the developer container containing a two-component developer, the two-component developer comprising toner particles and magnetic carrier particles, the magnetic carrier particles having a ten-point average surface roughness Rz of 0.5 to 3.0 μm; and a developer bearing member, the developer bearing member being a cylindrical member containing a magnetic field generator having multiple magnetic poles, the developer bearing member being adapted to bear the two-component developer on a surface thereof and to convey the two-component developer as the surface rotates, the developer bearing member having a ten-point average surface roughness Rz of 10 to 30 μm, wherein the multiple magnetic poles include three developer bearing poles each adapted to generate a magnetic field having a strength enough for retaining the two-component developer on a surface of the developer bearing member, and the three developer bearing poles consist of a developing pole, a pre-developing pole, and a post-developing pole, wherein the developing pole is adapted to generate a first magnetic field in a developing area in which the developer bearing member faces an electrostatic latent image bearing member, wherein the pre-developing pole is adapted to generate a second magnetic field, the second magnetic field supplying the two-component developer from the developer container to a surface of the developer bearing member and conveying the two-component developer to the developing area, the second and first magnetic fields retaining the two-component developer on a surface of the developer bearing member between a position where the two-component developer is supplied thereto and the developing area, and wherein the post-developing pole is adapted to generate a third magnetic field, the third magnetic field separating the two-component developer from the developer bearing member at a downstream side from the developing area and an upstream side from the developing pole relative to a direction of rotation of the developer bearing member, the first and third magnetic fields retaining the two-component developer on a surface of the developer bearing member between the developing area and a position where the two-component developer is separated therefrom.

2. The developing device according to claim 1, wherein each of the magnetic carrier particles includes:

a core material; and a covering layer covering the core material, the covering layer including conductive fine particles, wherein the following formula is satisfied:

$$0.5 \leq (D/h) \leq 1.1$$

wherein D represents a volume average particle diameter of the conducive fine particles and h represents an average thickness of the covering layer.

3. The developing device according to claim 2, wherein the average thickness of the covering layer is 0.05 to 4 μm.

4. An image forming apparatus, comprising:

an electrostatic latent image bearing member;

an electrostatic latent image forming device adapted to form an electrostatic latent image on the electrostatic latent image bearing member;

a developing device adapted to develop the electrostatic latent image into a toner image with a two-component developer, the developing device including:

a developer container, the developer container containing a two-component developer, the two-component developer comprising toner particles and magnetic carrier particles, the magnetic carrier particles having a ten-point average surface roughness Rz of 0.5 to 3.0 μm; and a developer bearing member, the developer bearing member being a cylindrical member containing a magnetic field generator having multiple magnetic poles, the developer bearing member being adapted to bear the two-component developer on a surface thereof and to convey the two-component developer as the surface rotates, the developer bearing member having a ten-point average surface roughness Rz of 10 to 30 μm, wherein the multiple magnetic poles include three developer bearing poles each adapted to generate a magnetic field having a strength enough for retaining the two-component developer on a surface of the developer bearing member, and the three developer bearing poles consist of a developing pole, a pre-developing pole, and a post-developing pole, wherein the developing pole is adapted to generate a first magnetic field in a developing area in which the developer bearing member faces the electrostatic latent image bearing member, wherein the pre-developing pole is adapted to generate a second magnetic field, the second magnetic field supplying the two-component developer from the developer container to a surface of the developer bearing member and conveying the two-component developer to the developing area, the second and first magnetic fields retaining the two-component developer on a surface of the developer bearing member between a position where the two-component developer is supplied thereto and the developing area, and wherein the post-developing pole is adapted to generate a third magnetic field, the third magnetic field separating the two-component developer from the developer bearing member at a downstream side from the developing area and an upstream side from the developing pole relative to a direction of rotation of the developer bearing member, the first and third magnetic fields retaining the two-component developer on a surface of the developer bearing member between the developing area and a position where the two-component developer is separated therefrom; and a transfer device adapted to transfer the toner image onto a recording medium; and a fixing device adapted to fix the toner image on the recording medium.

5. The image forming apparatus according to claim 4, wherein each of the magnetic carrier particles includes:

a core material; and a covering layer covering the core material, the covering layer including conductive fine particles, wherein the following formula is satisfied:

$$0.5 \leq (D/h) \leq 1.1$$

wherein D represents a volume average particle diameter of the conducive fine particles and h represents an average thickness of the covering layer.

6. The image forming apparatus according to claim 5, wherein the average thickness of the covering layer is 0.05 to 4 μm.

7. A process cartridge detachably attachable to image forming apparatus, comprising:

an electrostatic latent image bearing member; and a developing device adapted to develop the electrostatic latent image into a toner image with a two-component developer, the developing device including:

a developer container, the developer container containing a two-component developer, the two-component developer comprising toner particles and magnetic carrier particles, the magnetic carrier particles having a ten-point average surface roughness Rz of 0.5 to 3.0 μm; and a developer bearing member, the developer bearing member being a cylindrical member containing a magnetic field generator having multiple magnetic poles, the developer bearing member being adapted to bear the two-component developer on a surface thereof and to convey the two-component developer as the surface rotates, the developer bearing member having a ten-point average surface roughness Rz of 10 to 30 μm, wherein the multiple magnetic poles include three developer bearing poles each adapted to generate a magnetic field having a strength enough for retaining the two-component developer on a surface of the developer bearing member, and the three developer bearing poles consist of a developing pole, a pre-developing pole, and a post-developing pole, wherein the developing pole is adapted to generate a first magnetic field in a developing area in which the developer bearing member faces the electrostatic latent image bearing member, wherein the pre-developing pole is adapted to generate a second magnetic field, the second magnetic field supplying the two-component developer from the developer container to a surface of the developer bearing member and conveying the two-component developer to the developing area, the second and first magnetic fields retaining the two-component developer on a surface of the developer bearing member between a position where the two-component developer is supplied thereto and the developing area, and wherein the post-developing pole is adapted to generate a third magnetic field, the third magnetic field separating the two-component developer from the developer bearing member at a downstream side from the developing area and an upstream side from the developing pole relative to a direction of rotation of the developer bearing member, the first and third magnetic fields retaining the two-component developer on a surface of the developer bearing member between the developing area and a position where the two-component developer is separated therefrom.

8. The process cartridge according to claim 7, wherein each of the magnetic carrier particles includes:

a core material; and a covering layer covering the core material, the covering layer including conductive fine particles, wherein the following formula is satisfied:

$$0.5 \leq (D/h) \leq 1.1$$

wherein D represents a volume average particle diameter of the conducive fine particles and h represents an average thickness of the covering layer.

9. The process cartridge according to claim 8, wherein the average thickness of the covering layer is 0.05 to 4 μm.

10. The developing device according to claim 1, wherein the developer bearing member having a ten-point average surface roughness Rz of 15 to 30 μm.

11. The developing device according to claim 2, wherein the following formula is satisfied: $0.5 \leq (D/h) \leq 0.9$.

* * * * *